US006986172B2

(12) United States Patent
Hidetaka et al.

(10) Patent No.: US 6,986,172 B2
(45) Date of Patent: Jan. 17, 2006

(54) FLUSH TOILET

(75) Inventors: Miyahara Hidetaka, Kitakyushu (JP); Noda Shosaku, Kitakyushu (JP); Shimbara Noboru, Kitakyushu (JP); Shibata Shinji, Kitakyushu (JP); Shinkawa Masahiro, Kitakyushu (JP); Matsuo Nobusuke, Kitakyushu (JP)

(73) Assignee: Toto, Ltd., Fukuoka (JP)

( * ) Notice: Subject to any disclaimer, the term of this patent is extended or adjusted under 35 U.S.C. 154(b) by 235 days.

(21) Appl. No.: 10/239,696

(22) PCT Filed: Mar. 27, 2001

(86) PCT No.: PCT/JP01/02467

§ 371 (c)(1),
(2), (4) Date: Sep. 25, 2002

(87) PCT Pub. No.: WO01/73229

PCT Pub. Date: Oct. 4, 2001

(65) Prior Publication Data

US 2003/0088910 A1 May 15, 2003

(51) Int. Cl.
*E03D 11/08* (2006.01)

(52) U.S. Cl. ..... 4/425; 4/421

(58) Field of Classification Search ..... 4/421–425
See application file for complete search history.

(56) References Cited

U.S. PATENT DOCUMENTS

| | | | | | |
|---|---|---|---|---|---|
| 1,111,746 | A | * | 9/1914 | Haas | 4/422 |
| 1,142,092 | A | * | 6/1915 | Haas | 4/422 |
| 1,998,861 | A | * | 4/1935 | Campus | 4/422 |
| 3,843,978 | A | * | 10/1974 | Ragot | 4/425 |
| 6,145,138 | A | | 11/2000 | Nakamura et al. | |

FOREIGN PATENT DOCUMENTS

| | | |
|---|---|---|
| JP | 3-90757 | 4/1991 |
| JP | 5-230861 | 9/1993 |
| JP | 6-299587 | 10/1994 |
| WO | WO-98/16696 | 4/1998 |

* cited by examiner

*Primary Examiner*—Gregory L. Huson
*Assistant Examiner*—Huyen Le
(74) *Attorney, Agent, or Firm*—Griffin & Szipl, P.C.

(57) ABSTRACT

A flush toilet comprises a toilet body having a bowl for storing wash water as water seal, first means for supplying the toilet body with pressurized wash water and second means for discharging the wash water substantially horizontally along the upper peripheral portion of the inner surface of the bowl to swirl it along the inner surface of the bowl.

27 Claims, 28 Drawing Sheets

FLUSH TOILET

TECHNICAL FIELD

The present invention relates to a flush toilet provided with a toilet body having a bowl for storing wash water as water seal and a device for supplying the toilet body with pressurized wash water.

BACKGROUND ART

A flush toilet provided with a toilet body having a bowl for storing wash water as water seal and a device for supplying the toilet body with pressurized wash water, wherein wash water led from a tank directly connected to the toilet body discharges substantially horizontally along the upper peripheral portion of the inner surface of the bowl to swirl along the inner surface of the bowl is disclosed in International Laid-Open Publication WO98/16696. The aforementioned flush toilet has an advantage in that it does not cause loud noise during its operation because the wash water swirls and goes down along the inner surface of the bowl to run into the water seal aslant.

The flush toilet disclosed in the International Laid-Open Publication WO98/16696 has a disadvantage in that the flow speed of the wash water swirling along the inner surface of the toilet body is low and it does not have strong detergency against the inner surface of the toilet body because the wash water with low water pressure led from the tank directly connected to the toilet body discharges substantially horizontally.

DISCLOSURE OF INVENTION

An object of the present invention is to provide a flush toilet wherein no loud noise is caused during operation, while strong detergency is achieved against the inner surface of the bowl.

In accordance with the present invention, there is provided a flush toilet comprising a toilet body having a bowl for storing wash water as water seal, first means for supplying the toilet body with pressurized wash water and second means for discharging the wash water substantially horizontally along the upper peripheral portion of the inner surface of the bowl to swirl it along the inner surface of the bowl.

The present flush toilet does not cause loud noise during its operation because the wash water swirls and goes down along the inner surface of the bowl to run into the water seal aslant. The wash water discharging from the second means is pressurized and provided with high water pressure. Therefore, the discharging wash water swirls along the inner surface of the toilet body at high speed to achieve strong detergency against the inner surface of the bowl. The wash water swirling along the inner surface of the bowl dwells on it for a long time to achieve strong detergency against it. In the present specification, the clause "pressurized wash water" means wash water provided with water pressure higher than that of wash water with about 250 mm of water head led from a tank directly connected to the toilet body. The pressurized wash water can be obtained by leading in pressurized city water directly from a water supply pipe, leading in reserved water from a tank installed on the roof of a house or a building, or leading in portable water through a pressure device such as a pump, etc.

In the present specification, the word "swirl" means that wash water discharging substantially horizontally substantially goes round the whole inner surface of the bowl before it reaches the water seal. When the wash water substantially goes round the whole inner surface of the bowl, it dwells on the inner surface of the bowl for a long time to enhance its detergency. When the wash water goes round half or so of the inner surface of the bowl before it reaches the water seal, the movement of the wash water does not correspond to "swirl".

In accordance with a preferred embodiment of the present invention, the flush toilet comprises a plurality of the second means.

Each wash water discharging from a plurality of the second means washes the inner surface of the bowl to enhance the detergency of the flush toilet. The wash waters may swirl in the same direction or in different directions.

In accordance with a preferred embodiment of the present invention, the inner surface of the bowl comprises an overhang at its upper end.

The overhang prevents the pressurized wash water discharging from the second means substantially horizontally from flowing out the bowl beyond the upper periphery of the bowl.

In accordance with a preferred embodiment of the present invention, the flush toilet further comprises a trap-way extending from the bottom of the bowl and third means for discharging wash water to direct it to an inlet of the trap-way.

A trap-way enables flushing of soil out the toilet body to enhance the efficiency of flushing soil. When the wash water discharging from the third means is directed to an inlet of the trap-way, the trap-way is filled up with the wash water promptly, a siphon phenomenon appears promptly, the time necessary for flushing the toilet body becomes short, and the quantity of wash water necessary for flushing the toilet body diminishes.

In accordance with a preferred embodiment of the present invention, the third means discharges pressurized wash water.

When the third means discharges pressurized wash water, the trap-way is filled up with the wash water promptly, a siphon phenomenon appears promptly, the time necessary for flushing the toilet body becomes short, and the quantity of wash water necessary for flushing the toilet body diminishes.

In accordance with a preferred embodiment of the present invention, the flush toilet further comprises fourth means for supplying non-pressurized wash water, and the third means discharges non-pressurized wash water.

Non-pressurized wash water led from a tank directly connected to the toilet body may be discharged from the third means in a district or in a house where pressurized wash water with ample flow rate cannot be obtained.

In accordance with a preferred embodiment of the present invention, the third means discharges the wash water below the water plane of the water seal.

The wash water discharging below the water plane of the water seal forces soil depositing on the bottom of the bowl directly into the trap-way to enhance the efficiency of flushing soil.

In accordance with a preferred embodiment of the present invention, the third means makes the discharging wash water swirl in the same direction as the pressurized wash water discharging from the second means.

When the wash water discharging from the third means swirls in the same direction as the water seal forced to swirl by the pressurized wash water discharging from the second means, a siphon phenomenon appears promptly, the time necessary for flushing the toilet body becomes short, and the quantity of wash water necessary for flushing the toilet body diminishes.

In accordance with a preferred embodiment of the present invention, the flush toilet further comprises fifth means for controlling the discharging of wash water from the second means and the discharging of wash water from the third means.

When the order, timing, combination, etc. of the discharging of wash water from the second means and the discharging of wash water from the third means are controlled appropriately, the time necessary for flushing the toilet body, the efficiency of flushing the toilet body, etc. can be optimized, and the quantity of wash water necessary for flushing the toilet body can be minimized.

In accordance with a preferred embodiment of the present invention, the fifth means controls the third means to discharge wash water after the pressurized wash water discharging from the second means reaches the water seal.

When the pressurized wash water reaches the water seal, the wash water entrains the water seal to swirl it, thereby forcing the water seal to flow into the trap-way. The wash water discharging from the third means entrains the water seal to force its flow into the trap-way. The pressurized wash water discharging from the second means and the wash water discharging from the third means entrain the water seal to promote its flow into the trap-way. Thus, the trap-way is filled up with the wash water promptly, a siphon phenomenon appears promptly, the time necessary for flushing the toilet body becomes short, and the quantity of wash water necessary for flushing the toilet body diminishes.

In accordance with a preferred embodiment of the present invention, the fifth means controls the third means to discharge wash water after the second means finishes discharging the pressurized wash water.

It can be assumed that the pressurized wash water reaches the water seal before the second means finishes discharging the pressurized wash water. Therefore, when the third means discharges the wash water after the second means has finished discharging the wash water, the pressurized wash water discharging from the second means and the wash water discharging from the third means entrain the water seal to promote its flow into the trap-way. Thus, the trap-way is filled up with the wash water promptly, a siphon phenomenon appears promptly, the time necessary for flushing the toilet body becomes short, and the quantity of wash water necessary for flushing the toilet body diminishes.

In accordance with a preferred embodiment of the present invention, the toilet body is made of ceramic and the second means comprises a nozzle mounted on the upper peripheral portion of the bowl.

In accordance with a preferred embodiment of the present invention, the flush toilet further comprises a pipe for leading the pressurized wash water to the nozzle.

When the pressurized wash water is led to a nozzle through a pipe to discharge from the nozzle, discharging direction of the wash water, discharging speed of the wash water, flow line of the discharging wash water and swirling flow of the wash water are stabilized and work for forming a wash water passage becomes easy.

In accordance with a preferred embodiment of the present invention, the quantity of wash water discharging from the toilet body when the toilet body is flushed is not more than 7 liters.

The swirling flow of the pressurized wash water discharging from the second means has large kinetic energy because it has high speed. The swirling flow of the pressurized wash water with large kinetic energy entrains the water seal to make it swirl at a high speed, thereby flushing the water seal and the soil promptly from the toilet body. Therefore, the toilet body can be flushed with 7 liters or less of the wash water. The water seal and the soil are entrained by not only the swirling flow of the pressurized wash water discharging from the second means but also the wash water discharging from the third means to be flushed from the toilet body promptly. Therefore, the toilet body can be flushed with 7 liters or less of the wash water.

In accordance with a preferred embodiment of the present invention, the flush toilet further comprises sixth means for mixing the pressurized wash water discharging from the second means with air.

A bubbly steam of wash water containing an abundance of micro air bubbles dispersed in the wash water does not splash or cause loud noise when it collides against a solid surface, while generates high frequency vibration when it collides against a solid surface to wash it strongly. Therefore, disposition of the means for mixing the pressurized wash water with air enhances the quietness and the detergency of the flush toilet.

In accordance with a preferred embodiment of the present invention, the flush toilet further comprises seventh means for controlling the flow rate of the pressurized wash water discharging from the second means.

It is possible to control the flow rate of the pressurized wash water to control the flow speed of the wash water, thereby controlling and optimizing the ratio of the mixed air to the wash water to generate a bubbly stream of wash water.

In accordance with a preferred embodiment of the present invention, the flush toilet further comprises an air intake pipe communicating with the sixth means at its one end and exposed to the atmosphere at its the other end.

Freedom in arranging an air intake increases by disposing an air intake pipe. Therefore, it becomes possible to arrange an air intake at a place shielded from the line of sight of a user of the flush toilet and free from splashed water. It becomes possible to keep noise generated in the sixth means apart from the user, thereby enhancing the quietness of the flush toilet.

In accordance with a preferred embodiment of the present invention, the air intake pipe comprises eighth means for discharging wash water flowing back from the sixth means.

When wash water flowing back from the sixth means is discharged from the air intake pipe, it becomes possible to mix wash water with air stably. Air flowing in the air intake pipe at high speed is prevented from contacting wash water to prevent generation of noise due to the contact of the air with the wash water.

In accordance with a preferred embodiment of the present invention, the other end of the air intake pipe exposed to the atmosphere opens in the inner surface of the bowl of the toilet body above the water seal.

When the other end of the air intake pipe exposed to the atmosphere opens in the inner surface of the bowl of the toilet body above the water seal, it becomes possible to discharge the wash water flowing back from the sixth means to the bowl. Therefore, it becomes possible to discharge the wash water to the bowl when the second means clogs.

In accordance with a preferred embodiment of the present invention, the sixth means comprises an exhaust nozzle for wash water, an air intake exposed to the atmosphere, an air contact chamber disposed downstream of and close to the exhaust nozzle, communicating with the air intake, storing sucked air temporarily, and making the wash water discharging from the exhaust nozzle contact the stored air, and an air mix chamber disposed downstream of the air contact chamber and mixing the wash water with the air.

Air passes through the air intake and flows into the air contact chamber, contacts wash water exhausting from the exhaust nozzle, is applied with friction force from the wash water, and is entrained by the wash water to flow into the air mix chamber. The wash water and the air are mixed with each other in the air mix chamber to generate a bubbly stream of wash water.

In accordance with a preferred embodiment of the present invention, the flush toilet further comprises ninth means for dispersing wash water exhausting from the exhaust nozzle in the air contact chamber.

When wash water exhausting from the exhaust nozzle disperses in the air contact chamber, the contact area between the wash water and air increases, the quantity of air entrained by the wash water to flow into the air mix chamber increases, the ratio of the mixed air to the wash water increases, and generation of a bubbly stream of wash water is promoted. When the wash water disperses, the air is mixed with the wash water uniformly, and the bubbly stream of wash water becomes more stable. When the wash water disperses, mixing of micro air bubbles with the wash water is promoted, and it becomes possible to generate the bubbly stream of wash water without using a device for breaking air bubbles.

In accordance with a preferred embodiment of the present invention, the ninth means generates turbulence in the wash water at the exhaust nozzle or at a position upstream of and close to the exhaust nozzle.

When the wash water becomes turbulent at the exhaust nozzle or at a position upstream of and close to the exhaust nozzle, the wash water exhausting from the exhausting nozzle into the air forms a turbulent flow structured by a main flow and branched flows having components of flow speed different from that of the main flow. The branched flows project from the surface of the main flow just after exhausting from the exhaust nozzle to be separated from the main flow due to surface tension and friction force applied by the air around the flows, thereby forming water drops and dispersing radially.

In accordance with a preferred embodiment of the present invention, the sectional areas of the air contact chamber and the wash water passage downstream of the air contact chamber are larger than that of the exhaust nozzle.

The wash water flows in the air contact chamber and the wash water passage downstream of the air contact chamber is mixed with air and apparent flow rate of the wash water increases. Therefore, the sectional areas of the air contact chamber and the wash water passage downstream of the air contact chamber should be larger than that of the exhaust nozzle.

In accordance with a preferred embodiment of the present invention, the air intake is connected to the air contact chamber through an air intake pipe.

Freedom in arranging the air intake increases owing to provision of the air intake pipe. Therefore, it becomes possible to arrange the air intake at a place shielded from the line of sight of a user of the flush toilet and free from splashed water. It becomes possible to keep noise generated in the sixth means apart from the user, thereby enhancing the quietness of the flush toilet.

In accordance with a preferred embodiment of the present invention, the air intake pipe comprises tenth means for discharging the wash water flowing back from the air contact chamber.

When the wash water flowing back from the air contact chamber is discharged from the air intake pipe, it becomes possible to mix the wash water with air stably. The air flowing in the air intake pipe at high speed is prevented from contacting the wash water to prevent generation of noise due to the contact of the air with the wash water.

In accordance with a preferred embodiment of the present invention, the air intake opens in the inner surface of the bowl of the toilet body above the water seal.

When the air intake opens in the inner surface of the bowl of the toilet body above the water seal, it becomes possible to discharge the wash water flowing back from the air contact chamber to the bowl. Therefore, it becomes possible to discharge the wash water to the bowl when the second means clogs.

In accordance with a preferred embodiment of the present invention, the air mix chamber is bent.

When the wash water collides against the bent portion of the air mix chamber, the flow speed of the wash water decreases. When the speed reduction of the wash water occurs steadily in the air mix chamber, the wash water is stored temporarily in the air mix chamber. Thus, mixing of the wash water with the air is promoted. When the wash water flowing into the air mix chamber from the air contact chamber collides against the wash water temporarily stored in the air mix chamber, the air bubbles dispersing in the wash water are further broken up, and the generation of the bubbly stream of wash water is further promoted. When the air mix chamber is bent by about 90 degrees, the temporary storage of the wash water in the air mix chamber and the discharge of the bubbly stream of wash water from the air mix chamber are optimized.

In accordance with a preferred embodiment of the present invention, the flush toilet further comprises eleventh means for rectifying the bubbly stream of wash water downstream of the air mix chamber.

When the eleventh means for rectifying the bubbly stream of wash water is disposed downstream of the air mix chamber, the bubbly stream of wash water is prevented from becoming turbulent and gas-liquid separation due to turbulent flow is prevented.

BEST MODE FOR CARRYING OUT THE INVENTION

A flush toilet in accordance with a first preferred embodiment of the present invention will be described.

Figure 1:
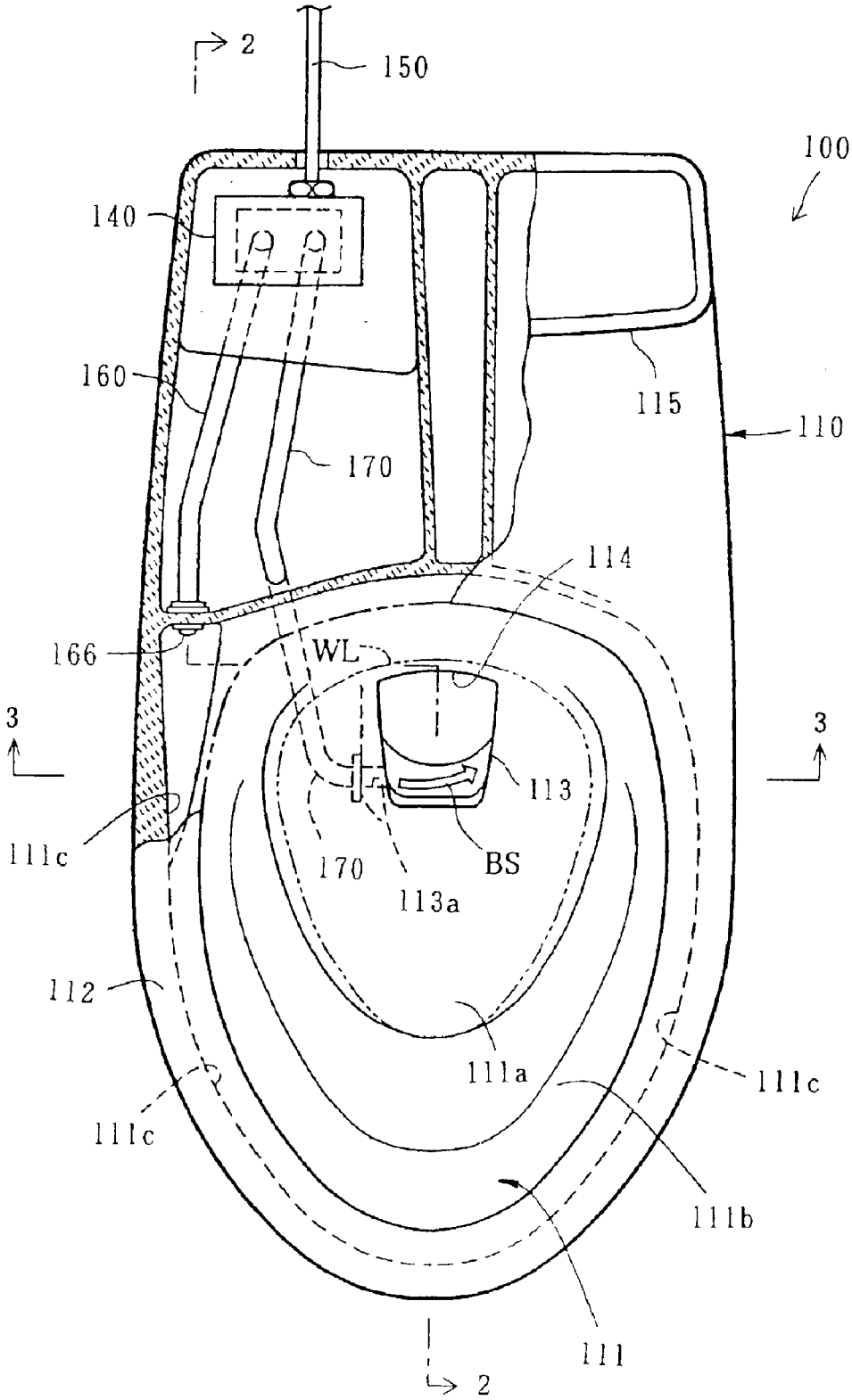
FIG. 1 is a partially cutaway plan view of a flush toilet in accordance with a first preferred embodiment of the present invention.
Figure 2:
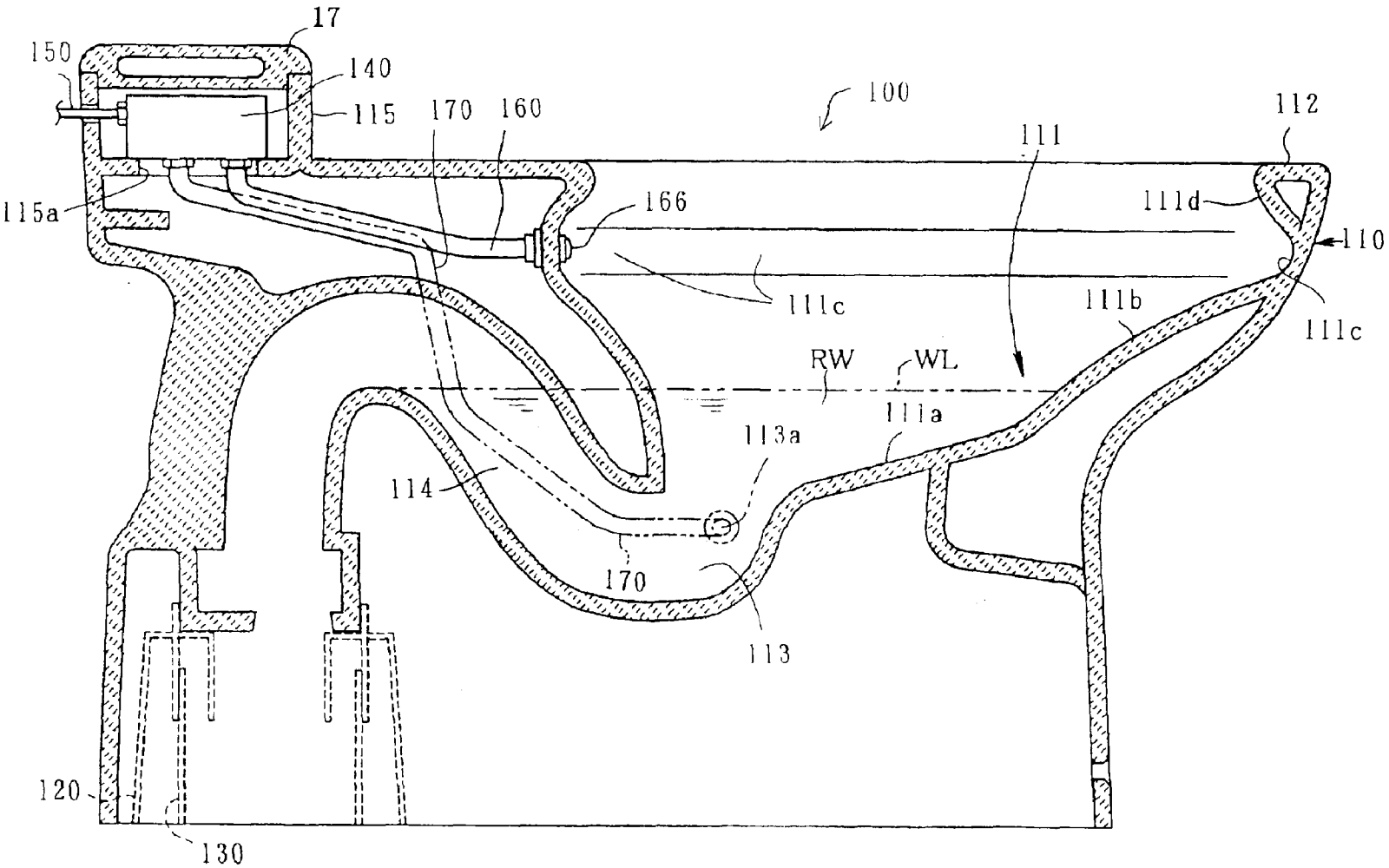
FIG. 2 is a sectional view taken along arrows 2—2 in FIG. 1.
Figure 3:
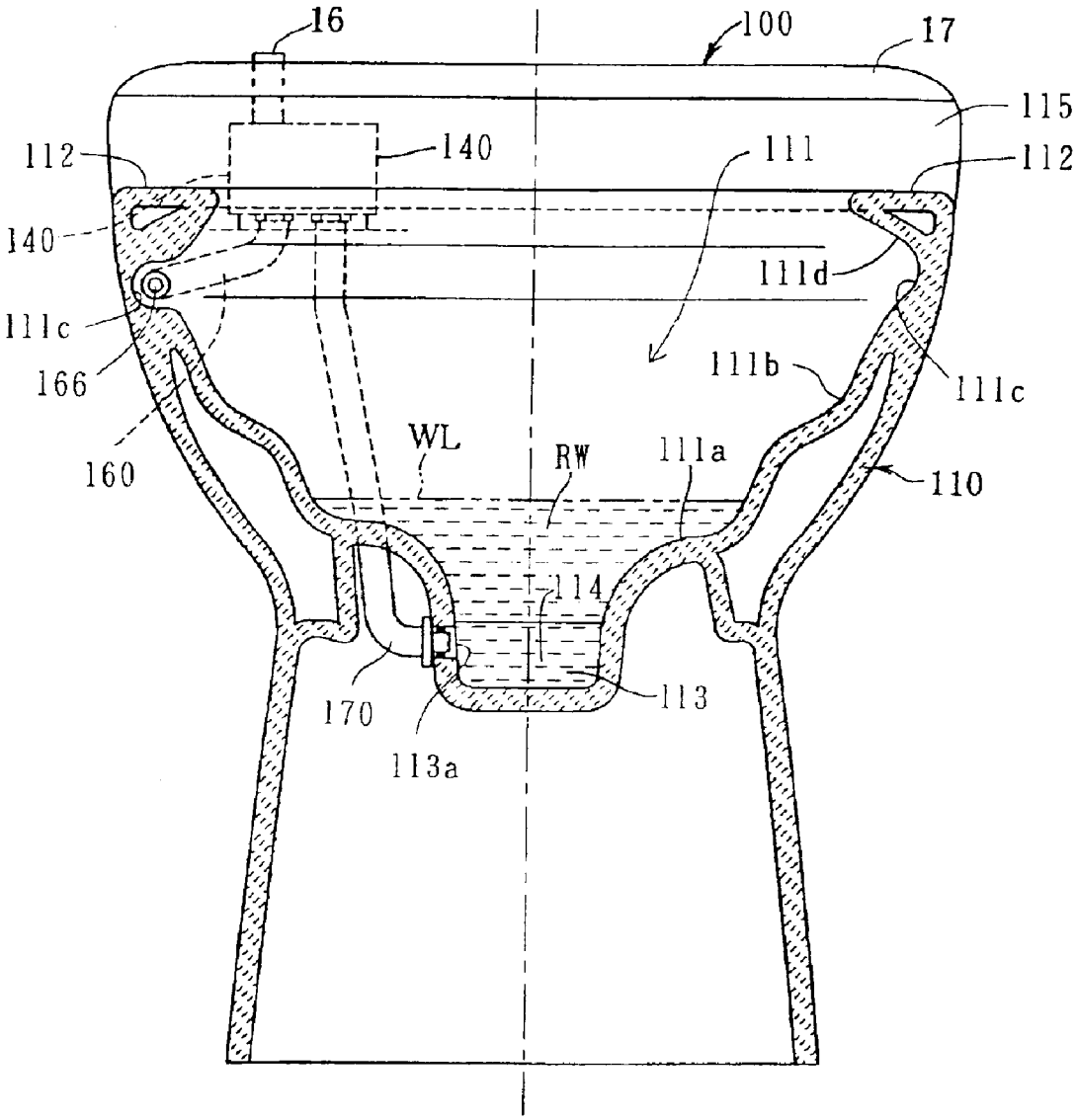
FIG. 3 is a sectional view taken along arrows 3—3 in FIG. 1.

As shown in FIGS. 1 to 3, a flush toilet 100 in accordance with a first preferred embodiment of the present invention is provided with a toilet body 110 made of ceramic. The toilet body 110 is provided with a bowl 111. The bowl 111 forms a wet surface 111*a* contacting water seal RW at the lower part of its inner surface and a dry surface 111*b* not contacting the water seal RW at the upper part of its inner surface. The dry surface 111*b* is provided with an annulus concave 111*c* at its upper peripheral portion. The annulus concave 111*c* extends substantially horizontally. The bowl 111 forms an annulus rim at its upper end. An overhang 111*d* extends from the annulus concave 111*c* to the annulus rim 112.

The bowl 111 is provided with a concave 113 at its bottom. A trap-way 114 with reversed S shape extends rearward from a side of the concave 113. The trap-way 114 is connected to a discharge pipe 130 at its downstream end through a socket 120.

The toilet body 110 is provided with a housing 115 to the rear of the bowl 111 and on the annulus rim 112.

Figure 4:
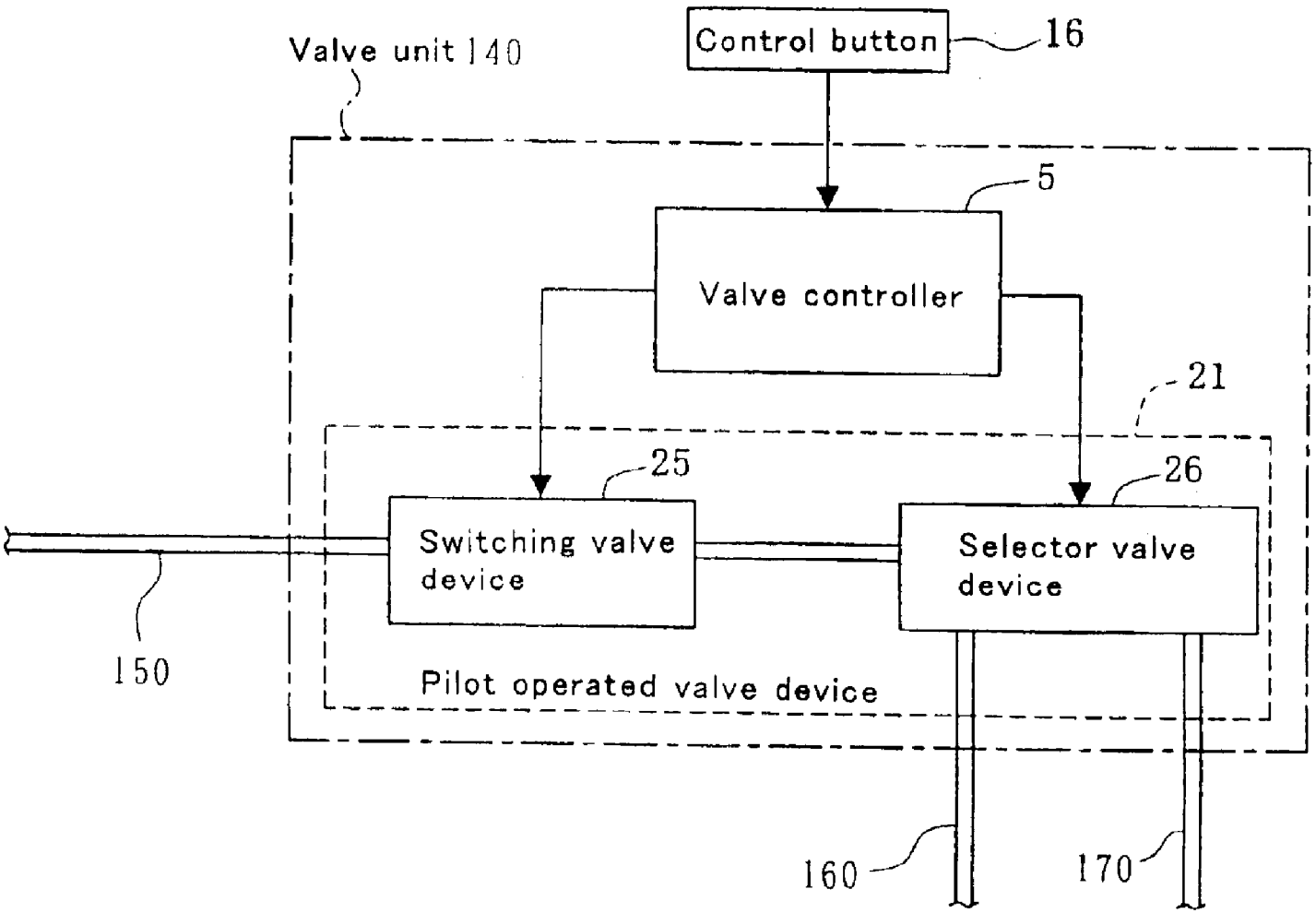
FIG. 4 is a block diagram of a valve unit.

A valve unit 140 is installed in the housing 115. The valve unit 140 connects to a feed water pipe 150 extending from a pressurized water source such as a city water supply pipe, a tank set on the roof of a house or a building, a pump, etc. As shown in FIG. 4, the valve unit 140 is provided with a control button 16, a valve controller 5 driven by the control button 16, a switching valve device 25 driven by the valve controller 5, and a selector valve device 26. The switching valve device 25 and the selector valve device 26 collaborate to form a pilot operated valve device 21. The switching valve device 25 connects to the feed water pipe 150. The selector valve device 26 is disposed downstream of the switching valve device 25. A rim water pipe 160 extends from the selector valve device 26 to the annulus concave 111*c* in the bowl 111 through a void space formed in the toilet body 110. A jet water pipe 170 extends from the selector valve device 26 to the concave 113 in the bowl 111 through a void space formed in the toilet body 110. As shown in FIG. 3, the control button 16 penetrates a cover 17 of the housing 115 and extends upward.

Figure 5:
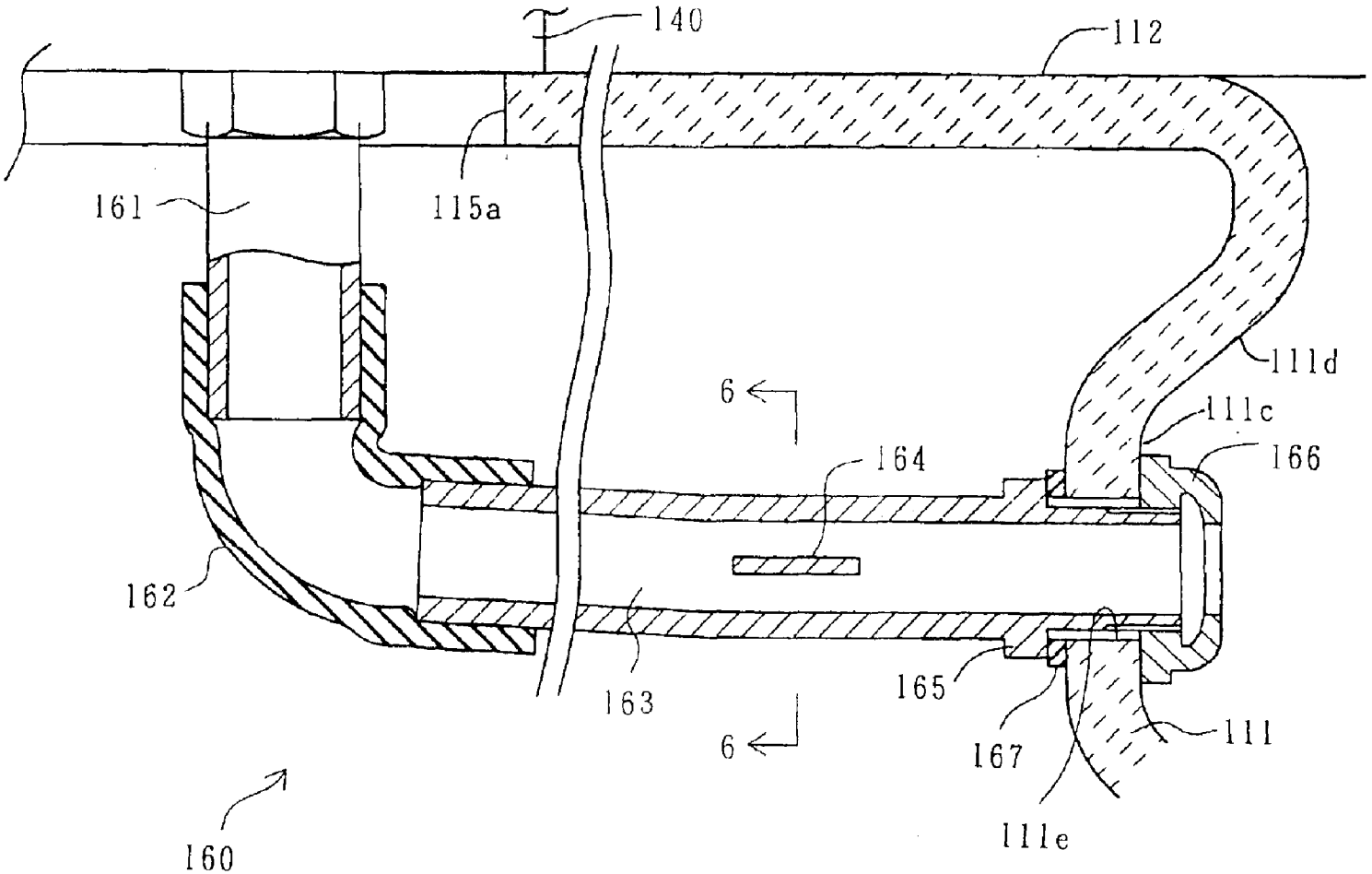
FIG. 5 is a side sectional view of a rim water pipe.
Figure 6:
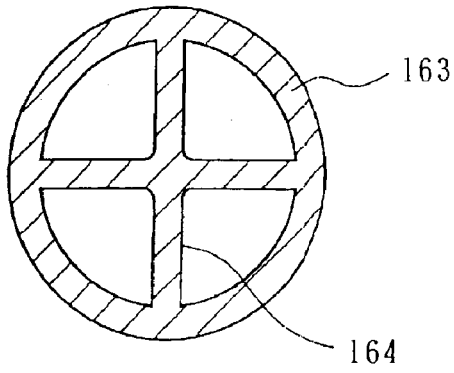
FIG. 6 is a sectional view taken along arrows 6—6 in FIG. 5.

As shown in FIGS. 5 and 6, the rim water pipe 160 is provided with a straight pipe 161 extending into the housing 115 through an opening 115*a* formed in the bottom of the housing 115 to connect to the valve unit 140 at its one end, a bent pipe 162 connecting to the other end of the straight pipe 161 at its one end, and a straight pipe 163 connecting to the other end of the bent pipe 162 at its one end and projecting in the annulus concave 111*c* through an opening 111*e* formed in the bottom of the annulus concave 111*c* at its the other end. The straight pipes 161 and 163 are made of resin or metal, while the bent pipe 162 is made of flexible elastic material such as rubber, elastomer, soft resin, etc. The straight pipe 163 is provided with a grid like rectification disk 164 at its longitudinal middle and a flange 165 at a portion close to the other end. A nozzle 166 threads onto the other end of the straight pipe 163. The flange 165 and the nozzle 166 collaborate to clamp a sidewall of the bowl 111 with a seal member 167 inserted between them. As seen from FIGS. 1 and 3, the nozzle 166 is directed in parallel with the longitudinal axis of the annulus concave 111*c* and so as to form an anticlockwise swirl flow of wash water as seen from the above.

The jet water pipe 170 is made of resin or metal. The jet water pipe 170 extends into the housing 115 through the opening 115*a* formed in the bottom of the housing 115 to connect to the valve unit 140 at its one end. The jet water pipe 170 connects to a jet discharge nozzle 113*a* formed in the side wall of the concave 113 at its the other end. The jet discharge nozzle 113*a* is disposed below a water plane WL of the water seal RW. The connection between the other end of the jet water pipe 170 and the jet discharge nozzle 113*a* is sealed with an appropriate seal member. As seen from FIG. 1, the jet discharge nozzle 113*a* is directed so as to form an anticlockwise swirl flow of wash water as seen from the above.

The operation of the flush toilet 100 will be described.

A user manipulates the control button 16 in the valve unit 140 to drive the valve controller 5. The valve controller 5 drives the switching valve device 25 to open it. Pressurized wash water supplied from the pressurized water source such as a city water supply pipe, a tank set on the roof of a house or a building, a pump, etc. passes through the feed water pipe 150 and the switching valve device 25 to reach the selector valve device 26.

Figure 7:
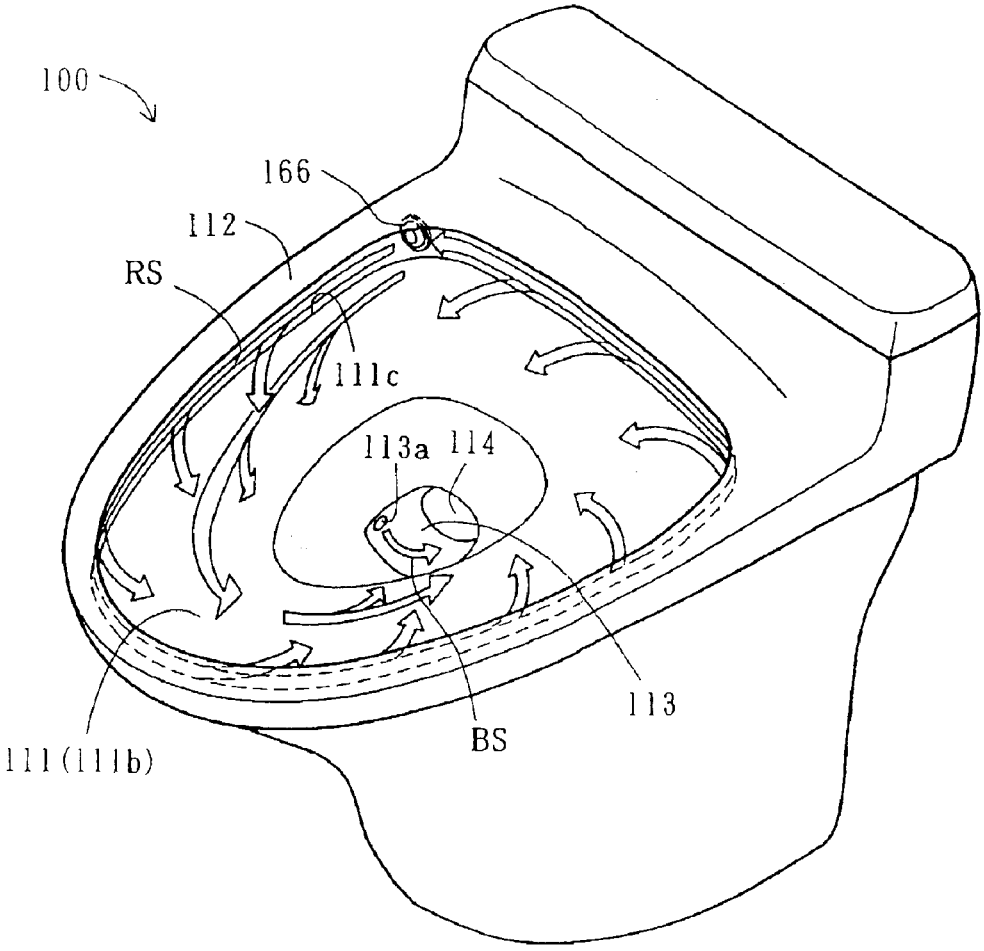
FIG. 7 is a perspective view of a toilet body showing behavior of rim flush water.

The valve controller 5 drives the selector valve device 26 to make the pressurized wash water flow into the rim water pipe 160. The pressurized wash water is passed through the rim water pipe 160, rectified with the rectification disk 164, and discharges into and in parallel with the annulus concave 111*c* from the nozzle 166. The pressurized wash water discharging from the nozzle 166 forms rim flush water RS as indicated by void arrows in FIG. 7. The rim flush water RS flows anticlockwise as seen from the above along the annulus concave 111*c* as indicated void arrows in FIG. 7, flows out the annulus concave 111*c* downward, flows gradually downward along the dry surface 111*b*, while branching into a plurality of branched flows, goes once or more round the dry surface 111*b* including the annulus concave 111*c*, and then reaches the water seal RW. The rim flush water RS flushes soil adhering to the dry surface 111*b*. The rim flush water RS joins with the water seal RW to drive it, thereby swirling it anticlockwise. The swirling water seal RW flows into the trap-way 114 extending from the side of the concave 113 with soil.

Figure 8:
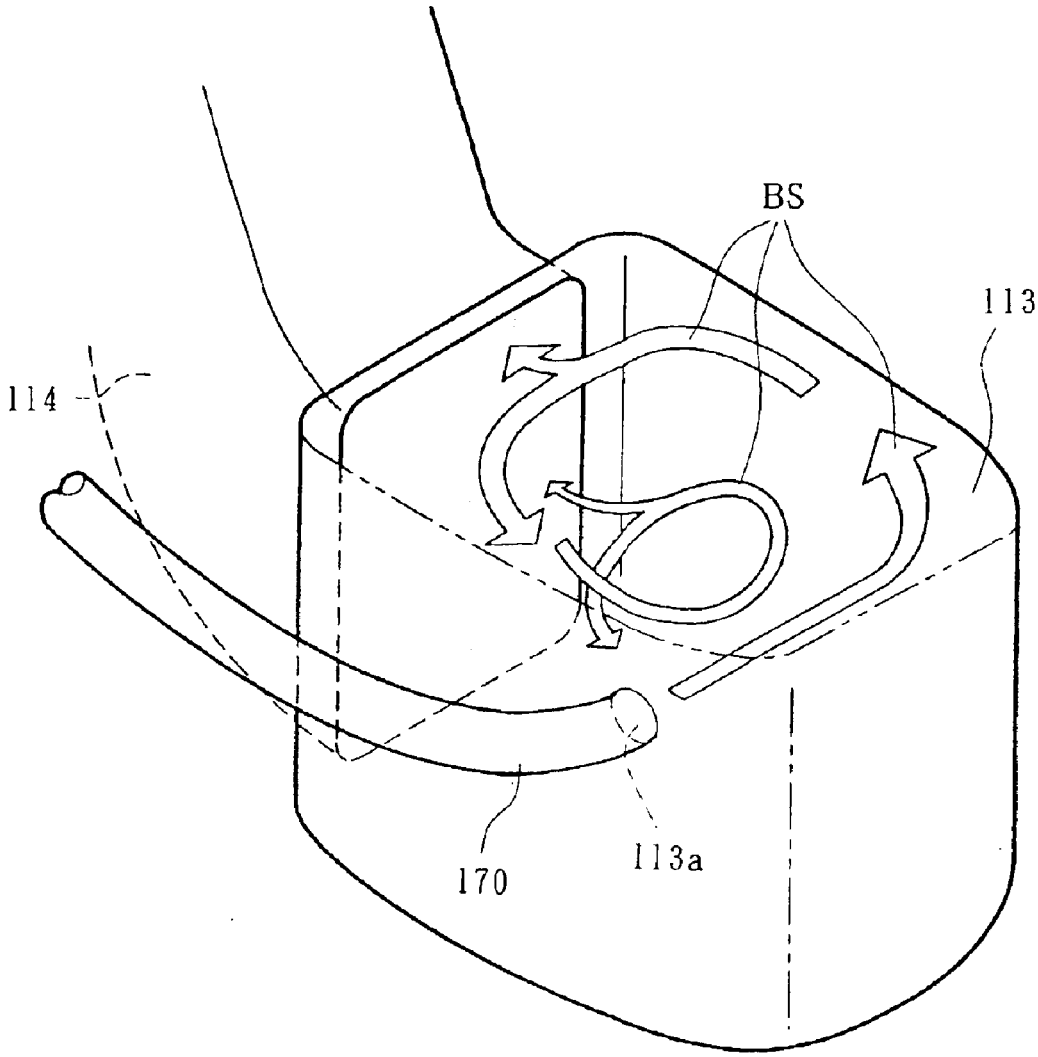
FIG. 8 is a perspective view of a toilet body showing behavior of jet flush water.

After the rim flush water RS reaches the water seal RW, the valve controller 5 drives the selector valve device 26 to stop the flow of the pressurized wash water into the rim water pipe 160 and lead the pressurized wash water into the jet water pipe 170. The pressurized wash water passes through the jet water pipe 170 and discharges into the concave 113 from the jet discharge nozzle 113*a*. The pressurized wash water discharging from the jet discharge nozzle 113*a* form jet flush water BS as indicated by void arrows in FIGS. 7 and 8. The jet flush water BS flows along the sidewall of the concave 113*a* to form a flow swirling anticlockwise as seen from the above. The swirling jet flush water BS not only flows into the trap-way 114 extending from the side of the concave 113 but also entrains the water seal RW swirling in the same direction to make it flow into the trap-way 114.

The water seal RW with which the rim flush water RS joins and the jet flush water BS flow into the trap-way 114, the trap-way 114 is filled the with wash water, a siphon phenomenon appears, and soil in the bowl 111 are discharged from the trap-way 114 to the discharge pipe 130 promptly.

After the bowl 111 becomes empty, the valve controller 5 drives the selector valve device 26 to stop the flow of the pressurized wash water into the jet water pipe 170 and lead the pressurized wash water into the rim water pipe 160. The rim flush water RS discharging from the nozzle 166 forms the water seal RW in the bowl 111.

After the water seal RW forms, the valve controller 5 stops the operation of the switching valve device 25 to close the switching valve device 25. The flow of the pressurized wash water into the bowl 111 stops and the flushing of the toilet body is completed.

The flush toilet 100 does not cause loud noise during its operation because the rim flush water RS swirls and goes down along the dry surface 111*b* to run into the water seal RW aslant. The rim flush water RS is pressurized wash water with water pressure higher than that of the wash water with about 250 mm of water head led from a tank directly connected to the toilet body. Therefore, the rim flush water RS swirls along the dry surface 111*b* at high speed to achieve a strong detergency against the dry surface 111*b*. The rim flush water swirling along the dry surface 111*b* by 360 degrees or more dwells on the dry surface 111*b* for a long time to achieve a strong detergency against the dry surface 111*b*.

The overhang 111*d* prevents the rim flush water RS discharging substantially horizontally from the nozzle 166 from running out the bowl 111 beyond the rim 112.

The trap-way 114 enables flushing of soil out the toilet body 110 to enhance the efficiency of flushing soil. The jet flush water BS discharging from the jet discharge nozzle 113*a* is swirled and directed to the inlet of the trap-way 114 formed in the side of the concave 113. Thus, the trap-way 114 is filled up with the wash water promptly, a siphon phenomenon appears promptly, the time necessary for flushing the toilet body becomes short, and the quantity of wash water necessary for flushing the toilet body diminishes.

When pressurized wash water discharges from the jet discharge nozzle 113*a*, the jet flush water BS flows into the trap-way 114 at high speed, and the quantity of the water seal RW entrained by the jet flush water BS to flow into the trap-way 114 increases. Thus, the trap-way 114 is filled up with the wash water promptly, a siphon phenomenon appears promptly, the time necessary for flushing the toilet body becomes short, and the quantity of wash water necessary for flushing the toilet body diminishes.

The jet flush water BS discharging below the water plane WL of the water seal RW forces the soil depositing on the concave 113 directly into the trap-way 114 to enhance the efficiency of flushing soil.

The jet flush water BS swirls in the same direction as the water seal RW to increase the flow rate of the water seal RW entrained by the jet flush water BS and flowing into the trap-way 114. Thus, the trap-way 114 is filled with the wash water promptly, a siphon phenomenon appears promptly, the time necessary for flushing the toilet body becomes short, and the quantity of wash water necessary for flushing the toilet body diminishes.

When the order, timing, combination, etc. of the rim flush water RS discharging from the nozzle 166 and the jet flush water BS discharging from the jet discharge nozzle 113*a* are controlled appropriately with the valve unit 140, the time necessary for flushing the toilet body, the efficiency of flushing the toilet body, etc. are optimized, and the quantity of wash water necessary for flushing the toilet body is minimized.

When the rim flush water RS reaches the water seal RW, the rim flush water RS entrains the water seal RW to swirl it, thereby forcing the water seal RW to flow into the trap-way 114. The jet flush water RS discharges after the rim flush water RS reaches the water seal RW to entrain the water seal RW, thereby forcing it to flow into the trap-way 114. The rim flush water RS and the jet flush water BS entrain the water seal RW to promote its flow into the trap-way 114. Thus, the trap-way 114 is filled up with the wash water promptly, a siphon phenomenon appears promptly, the time necessary for flushing the toilet body becomes short, and the quantity of wash water necessary for flushing the toilet body diminishes.

The size of the outlet, shape, surface roughness, etc. of the nozzle 166 can be optimized easily. Longitudinal distribution of diameter, distribution of surface roughness of the inner surface, etc. of the rim water pipe 160 can be optimized easily. Therefore, when the pressurized wash water is led to the nozzle 166 through the rim water pipe 160 and the rectification disk 164 disposed midway of the rim water pipe 160, the discharging direction, discharging speed, flow line and swirling flow of the rim flush water RS are stabilized easily. The rim water pipe 160 can contribute to easy formation of a wash water passage better than a water passage integrally formed in the toilet body 110.

The swirling flow of the rim flush water RS made of pressurized wash water has large kinetic energy because it has high speed. The swirling flow of the rim flush water RS with large kinetic energy entrains the water seal RW to make it swirl at high speed. Thus, the water seal RW flows into the trap-way 114 with soil promptly to be flushed from the toilet body 110. Therefore, the toilet body of the flush toilet 100 can be flushed with 7 liters or less of the wash water. The water seal RW and the soil are entrained by not only the swirling flow of the rim flush water RS made of the pressurized wash water but also the jet flush water BS to be promptly flushed from the toilet body 110. Therefore, the toilet body of the flush toilet 100 can be flushed with 7 liters or less of the wash water.

The structure of the valve unit 140 will be described in detail.

Figure 9:
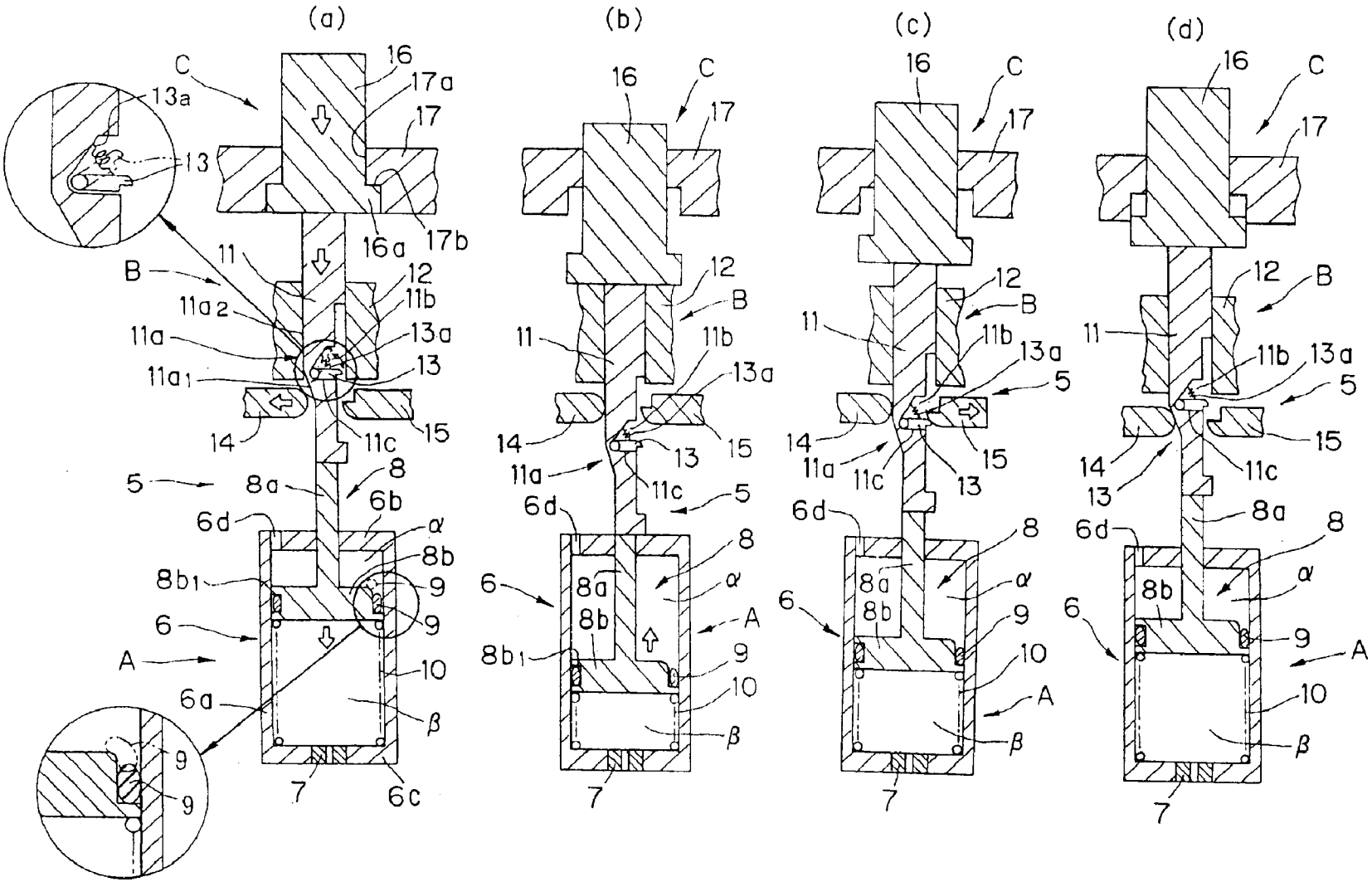
FIG. 9 is a side sectional view of a valve controller in the valve unit.

As shown in FIG. 9(*a*), the valve control device 5 in the valve unit 140 is provided with a mechanical timer A which also serves as a driving device, and a valve switching device B. The valve switching device B engages the control button 16 penetrating the cover 17 of the housing 115.

The mechanical timer A is provided with a cylinder 6. The cylinder 6 is provided with a circumferential wall 6*a* and end walls 6*b* and 6*c*. The end wall 6*b* is provided with an air hole 6*d*. The end wall 6*c* is provided with an orifice 7.

A piston 8 is inserted in the cylinder 6. The piston 8 is provided with a piston rod 8*a* and a piston head 8*b*. The piston rod 8*a* penetrates the end wall 6*b* to slide. The piston head 8*b* abuts against the inner surface of the circumferential wall 6*a* of the cylinder to slide. The abutment is sealed with an O-ring 9. The O-ring 9 is received in a groove $\mathbf{8}b_1$ formed in the circumferential surface of the piston head 8*b*. A side wall of the groove $\mathbf{8}b_1$ opposite the end wall 6*b* of the cylinder 6 is cut out partially over an appropriate length. A chamber α is formed between the piston head 8*b* and the end wall 6*b* and a chamber β is formed between the piston head 8*b* and the end wall 6*c*. A coil spring 10 is disposed in the chamber β.

The valve switching device B is provided with a spindle 11. The spindle 11 abuts against the free end of the piston rod 8*a* at its one end. The spindle 11 is inserted in a guide hole formed in a guide member 12 to be movable in the longitudinal direction. The spindle 11 is provided with a cam 11*a* on its one side surface. The cam 11*a* is provided with a slope $\mathbf{11}a_1$ adapted to increase the diameter of the spindle 11 from one end abutting against the free end of the piston rod 8*a* toward the other end and a straight surface $\mathbf{11}a_2$ connecting to the end of the slope $\mathbf{11}a_1$.

The spindle 11 is provided with a concave 11*b* on its the other side surface. A surface of the concave 11*b* crossing at right angles with the longitudinal axis of the spindle 11 forms a cam 11*c*. A cam engaging member 13 is disposed in the concave 11*b*. The cam engaging member 13 is connected to the spindle 11 to swing between a first position indicated by a solid line in FIG. 9(*a*) where the cam engaging member 13 abuts against the cam lie to project outward radially from the spindle 11 at its one end and a second position indicated by a phantom line in FIG. 9(*a*) where the cam engaging member 13 leaves the cam 11*c* to be received in the concave 11*b* as a whole. The cam engaging member 13 stays at the first position under a force of a weak return spring 13*a* when no load is applied to the cam engaging member 13.

A cam rod 14 is disposed opposite the cam 11*a* of the spindle 11 and at right angles to the longitudinal axis of the spindle 11. A cam rod 15 is disposed opposite the cam engaging member 13 and at right angles to the longitudinal axis of the spindle 11. The cam rod 14 is connected to the switching valve device 25. The cam rod 15 is connected to the selector valve device 26.

The control button 16 is inserted in a guide hole formed in the cover 17 of the housing 115 to move in the longitudinal direction. The control button 16 abuts against the other end of the spindle 11 at its one end extending into the housing 115.

Figure 10:
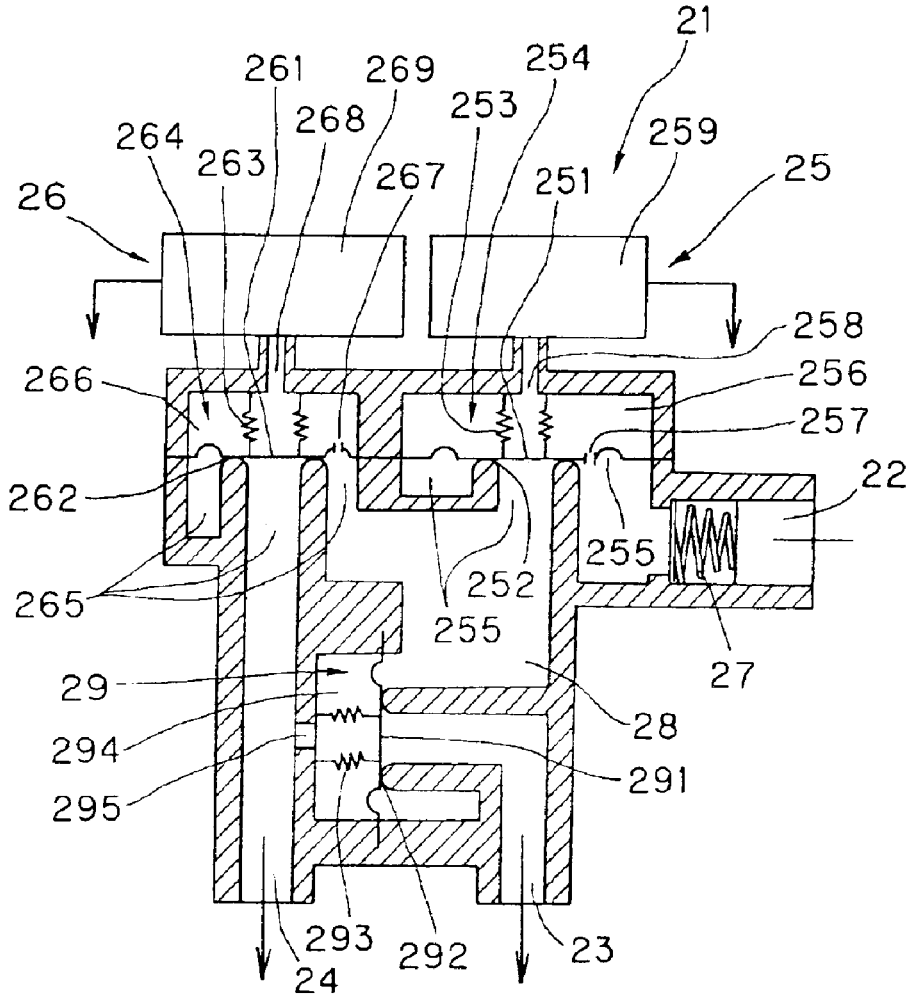
FIG. 10 is a side sectional view of a pilot operated valve device provided for the valve unit.

As shown in FIG. 10, a pilot operated valve device 21 is provided with an inlet 22 of the wash water, an outlet 23 of the wash water for rim discharging, an outlet 24 of the wash water for jet discharging, a switching valve device 25 and a selector valve device 26. The inlet 22 is connected to the feed water pipe 150. The outlet 23 is connected to the rim water pipe 160. The outlet 24 is connected to the jet water pipe 170.

The switching valve device 25 is provided with a diaphragm valve 254 structured by a diaphragm 251, a valve seat 252 and a biasing spring 253, and a wash water passage 255 switched by the diaphragm valve 254. The wash water passage 255 communicates with the inlet 22 through a flow regulating valve 27 and communicates with the chamber 28 when the diaphragm valve 254 opens.

The switching valve device 25 is provided with a pressure chamber 256. The diaphragm 251 forms a part of the enclosure of the pressure chamber 256. The diaphragm 251 is provided with a pilot inlet passage 257 communicating with the pressure chamber 256. A pilot outlet passage 258 extends from the pressure chamber 256. A pilot valve 259 for switching the pilot outlet passage 258 is disposed. The pilot valve 259 is provided with a valve body and a coil spring for forcing the valve body to close the pilot outlet passage 258. The valve body and the coil spring are not shown in Figures. The cam rod 14 is fixed to the valve body. The cam rod 14 is driven by the valve controller 5 shown in FIG. 9.

The selector valve device 26 is provided with a diaphragm valve 264 structured by a diaphragm 261, a valve seat 262 and a biasing spring 263, and a wash water passage 265 switched by the diaphragm valve 264. The wash water passage 265 communicates with a chamber 28 and communicates with the outlet 24 when the diaphragm valve 264 opens.

The selector valve device 26 is provided with a pressure chamber 266. The diaphragm 261 forms a part of the enclosure of the pressure chamber 266. The diaphragm 261 is provided with a pilot inlet passage 267 communicating with the pressure chamber 266. A pilot outlet passage 268 extends from the pressure chamber 266. A pilot valve 269 for switching the pilot outlet passage 268 is provided. The pilot valve 269 is provided with a valve body and a coil spring for forcing the valve body to close the pilot outlet passage 268. The valve body and the coil spring are not shown in Figures. The cam rod 15 is fixed to the valve body. The cam rod 15 is driven by the valve controller 5 shown in FIG. 9.

A diaphragm valve 29 is disposed between the chamber 28 and the outlet 23. The diaphragm valve 29 is structured by a diaphragm 291, a valve seat 292 and a biasing spring 293. A pressure chamber 294 is disposed. The diaphragm 291 forms a part of the enclosure of the pressure chamber 294. The pressure chamber 294 communicates with the outlet 24 through a communicating hole 295 downstream of the diaphragm valve 264.

The operation of the valve controller 5 and the pilot operated valve device 21 will be described.

When the flush toilet is not being used, the valve controller 5 is in the initial condition shown in FIG. 9(*a*). The control button 16 is located at a start point shown in FIG. 9(*a*) and projects from the cover 17. The spindle 11 of the valve switching device B is located at a start point and projects from the guide member 12. The cam engaging member 13 is located at the first position. The cam rod 14 is located between the cam 11*a* and the end wall 6*b* of the cylinder 6. The cam rod 15 is located between the cam engaging member 13 and the end wall 6*b* of the cylinder 6.

When the valve controller 5 is in the initial condition shown in FIG. 9(*a*), the valve body of the pilot valve 259 is forced by the coil spring in the direction for closing the pilot outlet passage 258 and the pilot valve 259 closes the pilot outlet passage 258. Thus, the wash water is prevented from entering into the pressure chamber 256. The upstream pressure of the diaphragm valve 254 is substantially the same as that in the pressure chamber 256 due to the pilot inlet passage 257. The force applied to the diaphragm 251 by the pressure in the pressure chamber 256 is larger than that by the pressure in the wash water passage 255 because the downstream pressure of the diaphragm valve 254 is lower than the upstream pressure of the diaphragm valve 254. The diaphragm 251 is forced by the spring 253. Therefore, the diaphragm 251 is forced against the valve seat 252, the diaphragm valve 254 or the switching valve device 25 closes the wash water passage 255, the rim flush water RS is not discharged from the nozzle 166, and the jet flush water BS is not discharged from the jet discharge nozzle 113*a*.

When the valve controller 5 is in the initial condition shown in FIG. 9(*a*), the valve body of the pilot valve 269 is forced by the coil spring in the direction for closing the pilot outlet passage 268 and the pilot valve 269 closes the pilot outlet passage 268. Thus, the wash water is prevented from entering into the pressure chamber 266. The diaphragm valve 264 or the selector valve device 26 closes the wash water passage 265 in the same way as the switching valve device 25.

When the valve controller 5 is in the initial condition shown in FIG. 9(*a*), the diaphragm 291 abuts the valve seat 292 under the biasing force of the spring 293. Thus, the diaphragm valve 29 intercepts the communication between the chamber 28 and the outlet 23.

A user of the flush toilet manually pushes the control button 16, the control button 16 starts to move toward the guide member 12, the spindle 11 starts outward movement from the start point toward the cylinder 6, and the piston head 8*b* starts to move in the cylinder 6 toward the end wall 6*c*, while compressing the coil spring 10.

As indicated by two-dot chain lines in FIG. 9(*a*), the O-ring 9 is exposed to a friction force from the circumferential wall 6*a* of the cylinder 6 to be extruded partially from the groove $8b_1$ through the cutout formed in the side wall of the groove $8b_1$. Thus, the seal by the O-ring 9 is broken. Air in the chamber β with its volume decreasing flows into the chamber a with its volume increasing through a space between the piston head 8*b* and the circumferential wall 6*a* of the cylinder 6. Air flows into the chamber α with its volume increasing through the air hole 6*d* formed in the end wall 6*b* of the cylinder 6.

Figure 11:
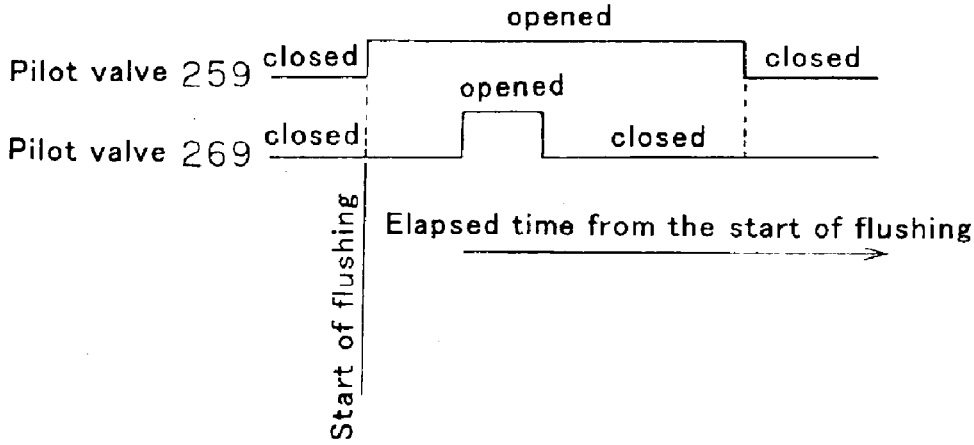
FIG. 11 is a time chart showing the operation of the pilot valve in the pilot operated valve device.

The cam 11*a* of the spindle 11 engages the cam rod 14 to drive the cam rod 14 in the direction indicated by a void arrow in FIG. 9(*a*) away from the spindle 11. The cam 11*a* drives the valve body of the pilot valve 259 in the switching valve device 25 in the direction for opening the pilot outlet passage against the biasing force of the coil spring. Thus, the pilot valve 259 opens the pilot outlet passage 258. When the pilot outlet passage 258 opens, the wash water flows into the pressure chamber 256 through the pilot inlet passage 257 and flows out the pressure chamber 256 through the pilot outlet passage 258. The aforementioned operations are caused immediately after pushing the control button 16. Therefore, the pilot valve 259 opens as shown in FIG. 11, simultaneously with the start of flushing due to pushing the control button 16.

The pressure in the pressure chamber 256 becomes lower than the upstream pressure of the diaphragm valve 254 due to the pressure loss generated when the wash water passes through the pilot inlet passage 257 with small diameter. The forces acting on the diaphragm 251 are thrown out of balance and the diaphragm 251 leaves the valve seat 252 to move toward the pressure chamber 256. Thus, the diaphragm valve 254 or the switching valve device 25 opens the wash water passage 255.

Figure 12:
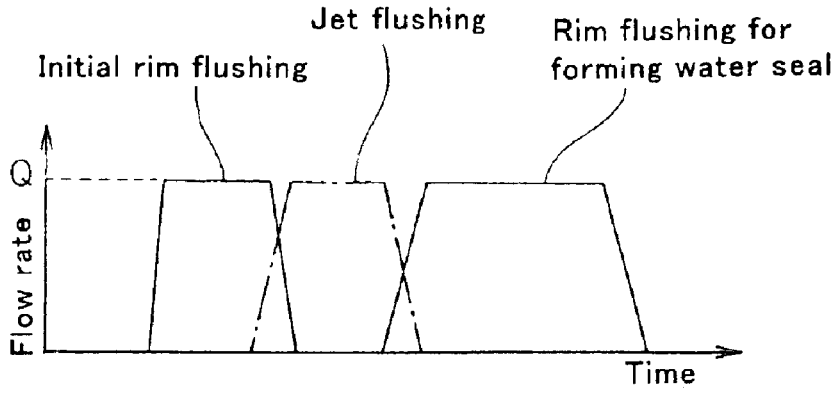
FIG. 12 is a time chart of the flushing of the toilet body.

The wash water passes through the inlet 22. The flow rate of the wash water is adjusted to a predetermined valve Q by the flow regulating valve 27. The wash water flows into the chamber 28 through the wash water passage 255. The pressure in the chamber 28 increases, the forces acting on the diaphragm 291 are thrown out of balance, and the diaphragm 291 leaves the valve seat 292 to move toward the pressure chamber 294. Thus, the diaphragm valve 29 communicates the chamber 28 with the outlet 23. When the chamber 28 communicates with the outlet 23, the wash water discharges from the outlet 23. The wash water discharging from the outlet 23 at flow rate Q passes through the rim water pipe 160 to discharge from the nozzle 166, thereby forming the rim flush water RS. The rim flush water RS carries out an initial rim flushing as shown in FIG. 12. During the initial rim flushing, the swirling flow of the pressurized wash water washes the dry surface 111*b* of the inner surface of the bowl strongly as aforementioned.

When the cam engaging member 13 contacts the cam rod 15, it swings from the first position to the second position under a load applied by the cam rod 15. Therefore, the cam 11*c* does not engage the cam rod 15 through the cam engaging member 13 and does not drive the valve body of the pilot valve 269 through the cam engaging member 13 and the cam rod 15. Therefore, the pilot valve 269 closes the pilot outlet passage 268, and the pilot valve 264 in the selector valve device 26 closes the wash water passage 265. Thus, the chamber 28 does not communicate with the outlet 24 and the jet flush water BS does not discharge from the jet discharge nozzle 113*a*.

As shown in FIG. 9(*b*), the control button 16 abuts against the guide member 12 to stop moving, the spindle 11 reaches the end point to stop moving, thereby finishing the manipulation to start flushing. When the manipulation to start flushing the toilet body is finished, the cam engaging member 13 is released from engaging the cam rod 15, and the cam engaging member 13 returns to the first position under the biasing force of the return spring 13*a*.

When the user of the flush toilet removes his or her hand from the control button 16, the piston head 8*b* starts to move toward the end wall 6*b* of the cylinder 6 as indicated by a void arrow in FIG. 9(*b*), the spindle 11 starts homeward movement from the end point to the start point, and the control button 16 starts to move away from the guide member 12 under the biasing force of the coil spring 10. The O-ring 9 is exposed to a friction force from the circumferential wall 6*a* of the cylinder 6 to return into the groove $\mathbf{8}b_1$ through the cutout formed in the side wall of the groove $\mathbf{8}b_1$. Thus, the seal by the O-ring 9 is restored. Air flows into the chamber β with its volume increasing through the orifice 7 and air flows out the chamber α with its volume decreasing through the air hole 6*d*. A part of the strain energy released from the coil spring 10 is consumed to become the heat when the air passes through the orifice 7. The increase rate of the volume of the chamber β and the speed of the homeward movement of the spindle 11 are regulated by the flow rate of the air passing through the orifice 7. The flow rate of the air passing through the orifice 7 is regulated by the spring constant of the coil spring 10 and the diameter of the orifice 7. The spindle 11 moves homeward at substantially constant speed determined by the spring constant of the coil spring 10 and the diameter of the orifice 7.

When the spindle 11 moves from the end point to the start point by a predetermined distance, or when a predetermined length of time elapses from the finish of the manipulation for starting the flushing, the cam engaging member 13 abuts against the cam rod 15 as shown in FIG. 9(*c*). Though a load is applied to the cam engaging member 13 by the cam rod 15, the cam engaging member 13 is only forced against the cam 11*c* and does not swing because the cam engaging member 13 is already returned to the first position under the biasing force of the return spring 13*a*. Therefore, the cam 11*c* engages the cam rod 15 through the cam engaging member 13 to drive the cam rod 15, and drive the valve body of the pilot valve 269 in the selector valve device 26 in the direction for opening the pilot outlet passage against the biasing force of the coil spring. Thus, the pilot valve 269 opens the pilot outlet passage 268 as shown in FIG. 11. When the pilot outlet passage 268 opens, the wash water flows into the pressure chamber 266 through the pilot inlet passage 267 and flows out the pressure chamber 266 through the pilot outlet passage 268.

The pressure in the pressure chamber 266 becomes lower than the upstream pressure of the diaphragm valve 264 due to the pressure loss generated when the wash water passes through the pilot inlet passage 267. The forces acting on the diaphragm 261 are thrown out of balance and the diaphragm 261 leaves the valve seat 262 to move toward the pressure chamber 266. Thus, the diaphragm valve 264 of the selector valve device 26 opens the wash water passage 265.

The wash water flows into the wash water passage 265 from the chamber 28 and discharges from the outlet 24. The wash water discharging from the outlet 24 at flow rate Q passes through the jet water pipe 170 to discharge from the jet discharge nozzle 113*a*. The jet flush water BS discharging from the jet discharge nozzle 113*a* carries out a jet flushing as shown in FIG. 12. The swirling jet flush water BS generates a siphon phenomenon in the trap-way 114 to discharge soil from the toilet body 110 promptly.

When the wash water flows to the outlet 24 through the opened wash water passage 265, a part of the wash water enters into the pressure chamber 294. Thus, the pressure in the pressure chamber 294 increases, the forces acting on the diaphragm 291 are thrown out of balance, and the diaphragm 291 is forced against the valve seat 292. Thus, the diaphragm valve 29 intercepts the communication between the chamber 28 and the outlet 23. Therefore, the wash water does not discharge from the nozzle 166 and the rim flushing is not carried out as shown in FIG. 12.

When the spindle 11 moves further from the position shown in FIG. 9(*c*) toward the start point, or when a predetermined length of time elapses from the point of time shown in FIG. 9(*c*), the cam 11*c* is released from engaging the cam rod 15 through the cam engaging member 13 as shown in FIG. 9(*d*). The valve body of the pilot valve 269 is released from the load by the cam rod 15 to move in the direction for closing the pilot outlet passage. Thus, the pilot valve 269 closes the pilot outlet passage 268 as shown in FIG. 11. The diaphragm valve 264 or the selector valve device 26 closes the wash water passage 265. The wash water stops discharging from the outlet 24, the jet flush water BS stops discharging from the jet discharge nozzle 113*a*, and the jet flushing is completed as shown in FIG. 12.

The wash water stops flowing to the outlet 24 from the wash water passage 265, the wash water flows out the pressure chamber 294 through the communication hole 295 to decrease the pressure in the pressure chamber 294, forces acting on the diaphragm 291 are thrown out of balance, the diaphragm 291 leaves the valve seat 292 to move toward the pressure chamber 294, and the diaphragm valve 29 communicates the chamber 28 with the outlet 23. The wash water discharges from the outlet 23. The wash water discharging from the outlet 23 at flow rate Q discharges from the nozzle 166. The rim flush water RS discharging from the nozzle 166 carries out a rim flushing for forming water seal as shown in FIG. 12. Thus, the water seal RW is formed in the bowl 110.

When a predetermined length of time elapses from the point of time shown in FIG. 9(*d*), the control button 16 returns to the start point where it projects from the cover 17 of the housing 115 and stops moving. The cam 11*a* is released from engaging the cam rod 14, the valve body of the pilot valve 259 moves in the direction for closing the valve under the biasing force of the coil spring, and the pilot valve 259 closes the pilot outlet passage 258 as shown in FIG. 11. The diaphragm valve 254 or the switching valve device 25 closes the wash water passage 255. Thus, the wash water stops discharging from the pilot operated valve device 21, the rim flushing for forming water seal is finished as shown in FIG. 12, and the flushing of the toilet body is finished.

It is possible to adjust the spring constant of the coil spring 10, diameter of the orifice 7, etc., thereby adjusting the speed of the homeward movement of the spindle 11, adjust the stroke of the homeward movement of the spindle 11 in the initial rim flushing, adjust the stroke of the homeward movement of the spindle 11 in the jet flushing, and adjust the stroke of the homeward movement of the spindle 11 in the rim flushing for forming water seal, thereby adjusting the duration of the initial rim flushing, the duration of the jet flushing and the duration of the rim flushing for forming water seal as shown in FIG. 12. The quantity of wash water used in each flushing can be adjusted by adjusting duration of each flushing because the flow rate of wash water in each flushing is kept constant, i.e. Q. Therefore, the quantity of discharging wash water in the initial rim flushing can be set at about 2 to 4 liters, the quantity of discharging wash water in the jet flushing can be set at about 3 liters, and the quantity of wash water discharged from the toilet body 110 in the flushing of the toilet body can be set at about 5 to 7 liters. The wash water discharging in the rim flushing for forming water seal is stored as water seal RW and not discharged from the toilet body 110.

The toilet body can be flushed even at an electric service interruption because the mechanical timer A drives the valve switching device B to control the switching valve device 25 and the selector valve device 26. The structure of the valve switching device B reciprocally moving to switch valves is simple. Thus, the structure of the valve controller 5 becomes simple. The mechanical timer A can be started by a single manipulation of pushing the control button 16 to the stop position.

In the pilot operated valve device 21, the pilot valves 259 and 269 are switched so that the switching valve device 25 switches the wash water passage and the selector valve device 26 selects one from a plurality of wash water passages. The pilot outlet passages 258 and 268 operate even though their diameters are small. Therefore, small valves needing small forces for driving them can be used as the pilot valves 259 and 269. Therefore, the forces applied to the cam rods 14 and 15 can be reduced and the valve controller 5 can be downsized. The force necessary for manipulating the control button 16 also can be reduced. When the pilot operated valve device 21 is used, the valve unit 40 is downsized, the housing 115 is downsized, and the toilet body 110 is downsized.

The flow rate of wash water in the initial rim flushing, the jet flushing and the rim flushing for forming water seal is regulated to Q with the flow regulating valve 27. Thus, no water hammer is caused when the selection of the wash water passage is carried out. Therefore, the pilot operated valve device 21 can be downsized and lightened, and the production cost of the pilot operated valve device can be reduced because the pressure resistance of the members in the pilot operated valve device 21 need not be excessively large.

Variations of the valve switching device B will be described.

Figure 13:
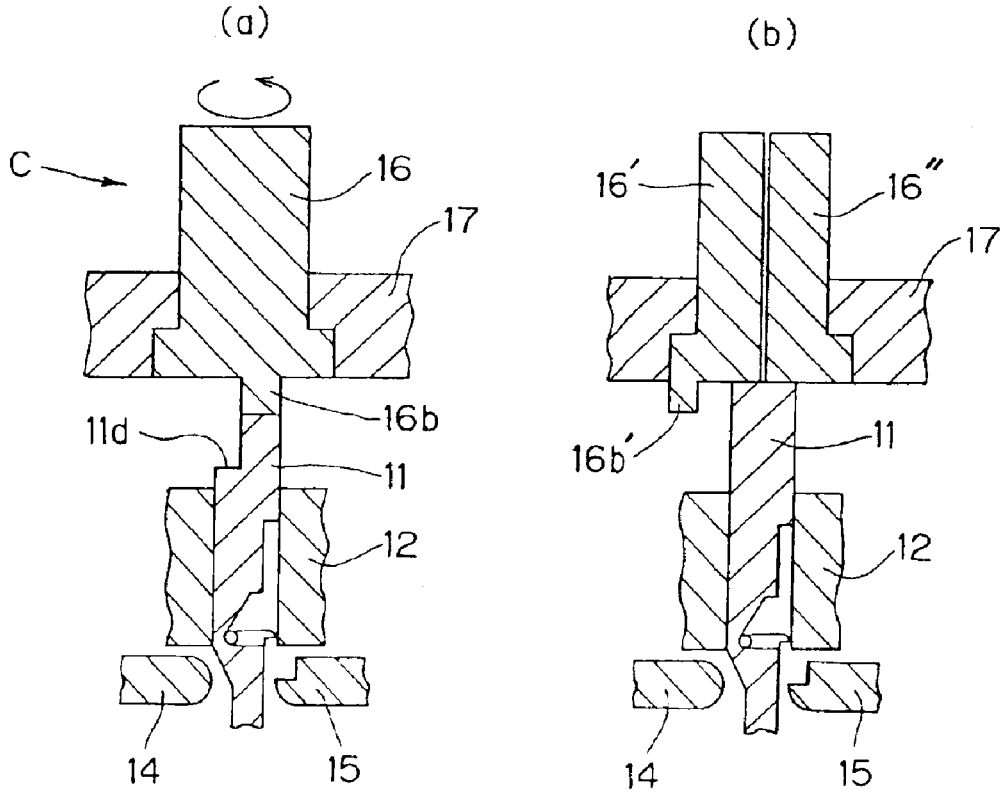
FIG. 13 is a partial side sectional view of a variation of the valve controller.

It is possible, as shown in FIG. 13(*a*), to provide the control button 16 with a projection 16*b*, engage the control button 16 with the cover 17 to rotate around a longitudinal axis of the control button 16, and provide the spindle 11 with a step 11*d* at its one end. When the valve controller 5 is in the initial condition, the control button 16 in a predetermined rotational region abuts the said one end of the spindle 11 at the projection 16*b*, but the control button 16 out of the predetermined rotational region is distanced from the said one end of the spindle 11. Thus, the stroke of the outward movement of the spindle 11 in the case where the control button 16 is rotated to a predetermined rotational point and pushed in the cover 17 becomes different from the stroke of the outward movement of the spindle 11 in the case where the control button 16 is pushed in the cover 17 without being rotated to the predetermined rotational point. Thus, the quantity of discharging wash water in the case where the control button 16 is rotated to a predetermined rotational point and pushed in the cover 17 becomes different from the quantity of discharging wash water in the case where the control button 16 is pushed in the cover 17 without being rotated to the predetermined rotational point. Thus, the quantity of discharging wash water in flushing the toilet body after defecating can be made different from the quantity of discharging wash water in flushing the toilet body after urinating with a simple device and wash water used for flushing the toilet body can be saved.

It is possible, as shown in FIG. 13(*b*), to divide the control button 16 into half portions 16' and 16", and provide the half portion 16' with a projection 16*b*'. In this case, the stroke of the movement of the half portion 16' when the half portion 16' is pushed in the cover 17 becomes different from the stroke of the movement of the half portion 16" when the half portion 16" is pushed in the cover 17, the stroke of the outward movement of the spindle 11 when the half portion 16' is pushed in the cover 17 becomes different from the stroke of the outward movement of the spindle 11 when the half portion 16" is pushed in the cover 17. Thus, the quantity of discharging wash water when the half portion 16' is pushed in the cover 17 becomes different from the quantity of discharging wash water when the half portion 16" is pushed in the cover 17. Thus, the quantity of discharging wash water in flushing the toilet body after defecating can be made different from the quantity of discharging wash water in flushing the toilet body after urinating with a simple device and wash water used for flushing the toilet body can be saved. The quantity of discharging wash water in flushing the toilet body after defecating can be made different from the quantity of discharging wash water in flushing the toilet body after urinating only by manipulating the desirable half portion 16' or 16". Thus, the flush toilet becomes more convenient.

A second preferred embodiment of the present invention will be described.

Figure 14:
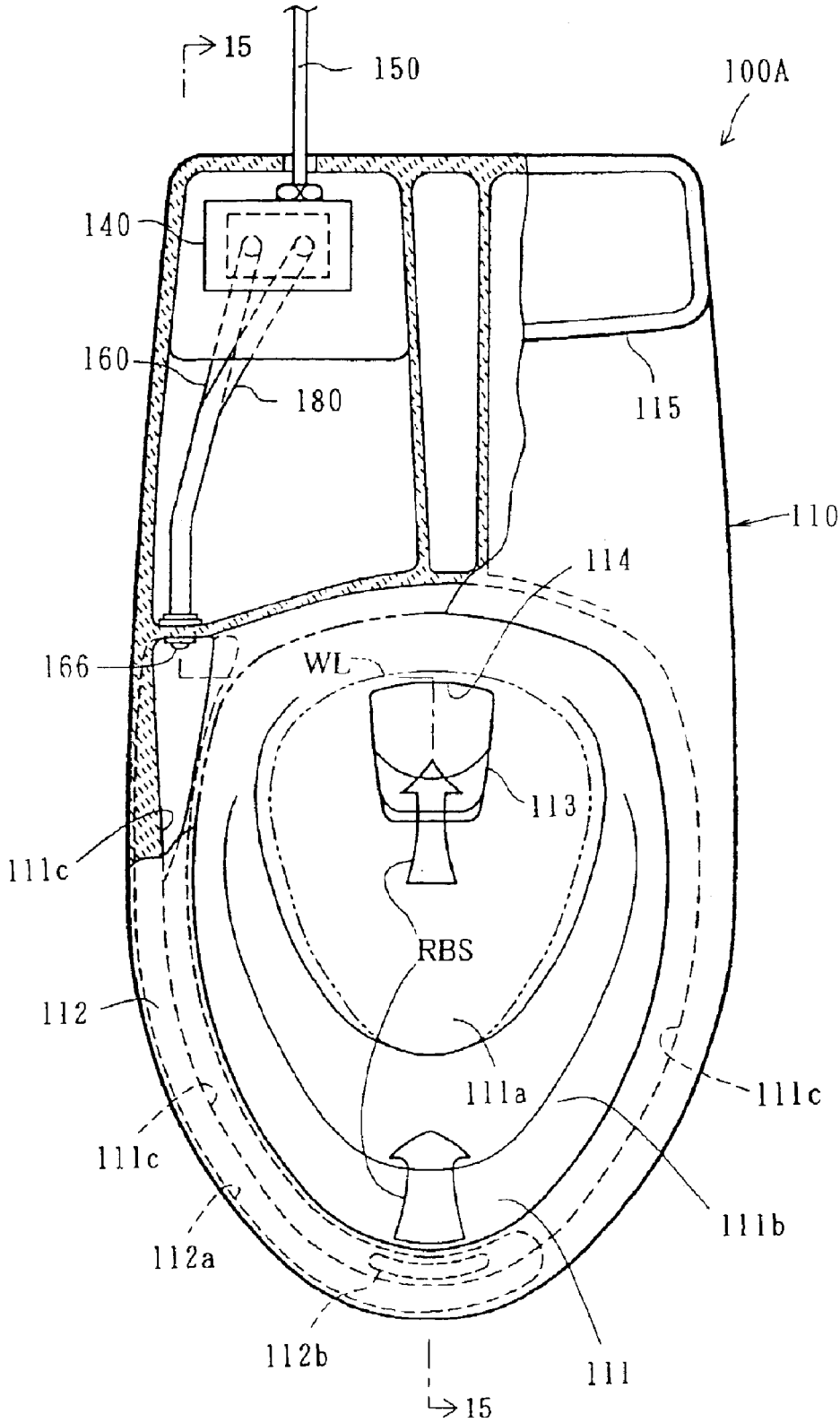
FIG. 14 is a partially cutaway plan view of a flush toilet in accordance with a second preferred embodiment of the present invention.
Figure 15:
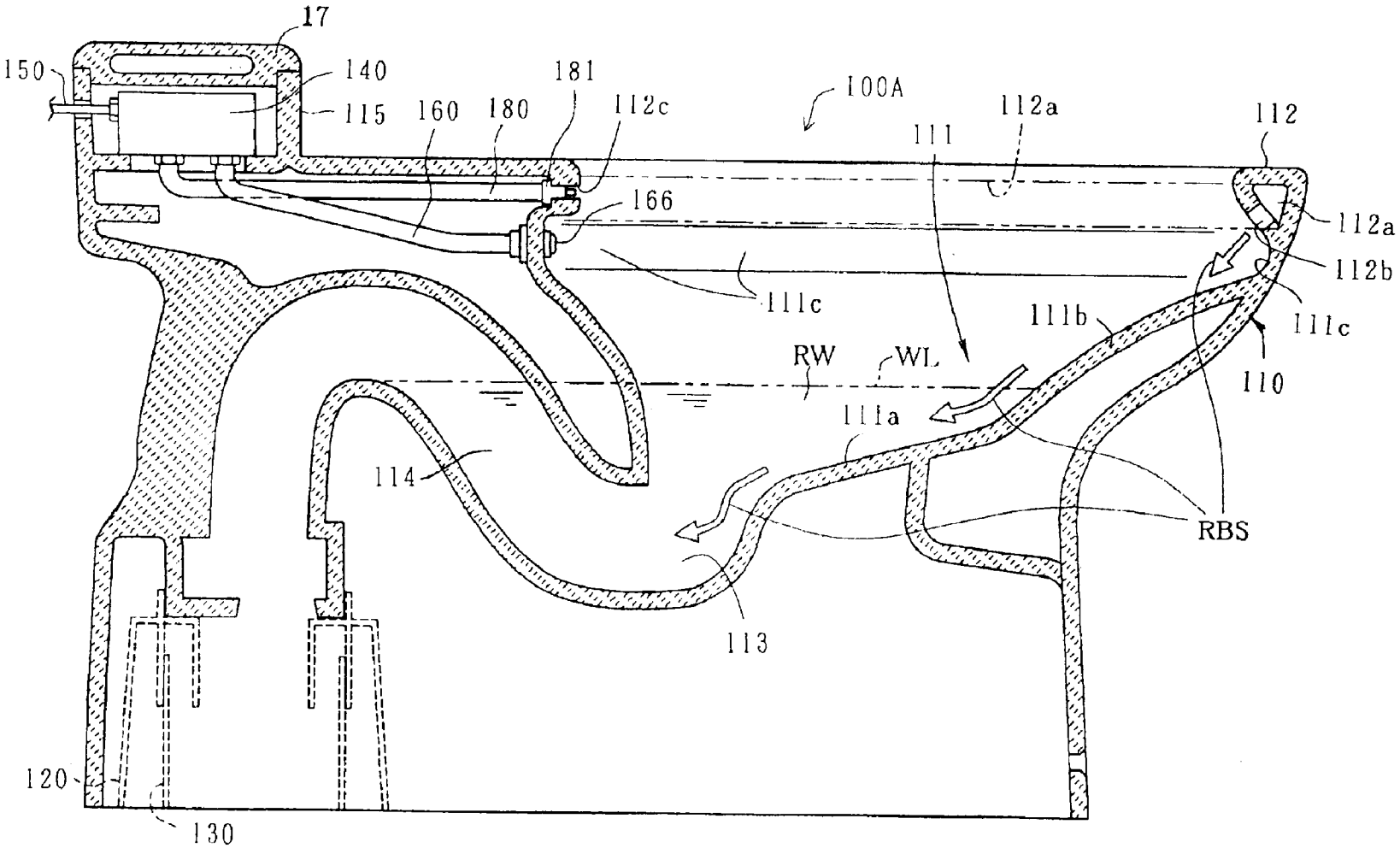
FIG. 15 is a sectional view taken along arrows 15—15 in FIG. 14.

As shown in FIGS. 14 and 15, in a flush toilet 100A in accordance with the present preferred embodiment, the rim 112 of the toilet body 110 is provided with a rim water passage 112*a* over a half round. The rim water passage 112*a* is provided with a rim discharge hole 112*b* directed aslant downward and toward the trap-way 114 at its end distanced from the housing 115. The rim water passage 112*a* is provided with a rim discharge hole 112*c* at its end close to the housing 115. A second rim water pipe 180 extends from the selector valve device 26 in the valve unit 140 instead of the jet water pipe 170 in the first preferred embodiment. The second rim water pipe 180 is provided with a nozzle 181 at its downstream end. The nozzle 181 is inserted in the rim discharge hole 112*c*. An appropriate seal member is inserted in the space between the second rim water pipe and the rim discharge hole. In the present embodiment, the jet water pipe 170 and the jet discharge nozzle 113*a* are not disposed. The flush toilet 100A has the same structure as the flush toilet 100 except for the aforementioned points.

In the flush toilet 100A, second rim flush water RBS discharges through the second rim water pipe 180, the rim water passage 112*a* and the rim discharge hole 112*b*. The second rim flush water RBS flows down straight along the dry surface 111*b* of the bowl 111 as indicated by void arrows to reach the water seal RW, entrains the water seal RW and soil, flows down straight along the wet surface 111*a*, and flows into the trap-way 114. Thus, a siphon phenomenon appears to discharge soil from the toilet body promptly.

A third preferred embodiment of the present invention will be described.

Figure 16:
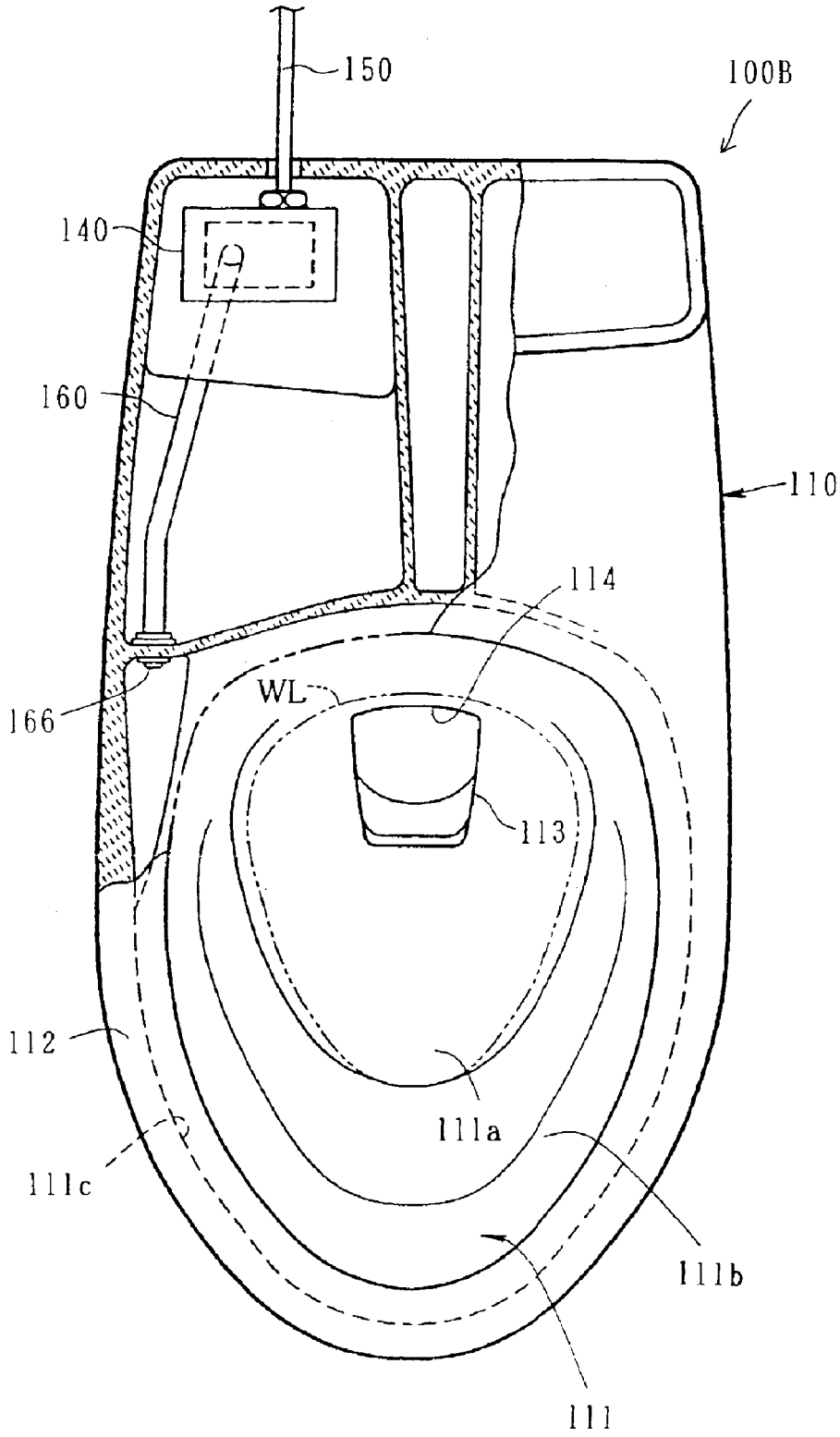
FIG. 16 is a partially cutaway plan view of a flush toilet in accordance with a third preferred embodiment of the present invention.

As shown in FIG. 16, a flush toilet 100B in accordance with the present preferred embodiment is not provided with a jet water pipe and a jet discharge nozzle. The valve unit 140 is not provided with a selector valve device and a device for driving the selector valve device. The flush toilet 100B has the same structure as the flush toilet 100 except for the aforementioned points.

In the flush toilet 100B, the toilet body is flushed only by the rim flush water discharging from the nozzle 166. The pressurized rim flush water swirls and flows down along the dry surface 111*b* to wash the dry surface 111*b* strongly without causing loud noise.

A fourth preferred embodiment of the present invention will be described.

Figure 17:
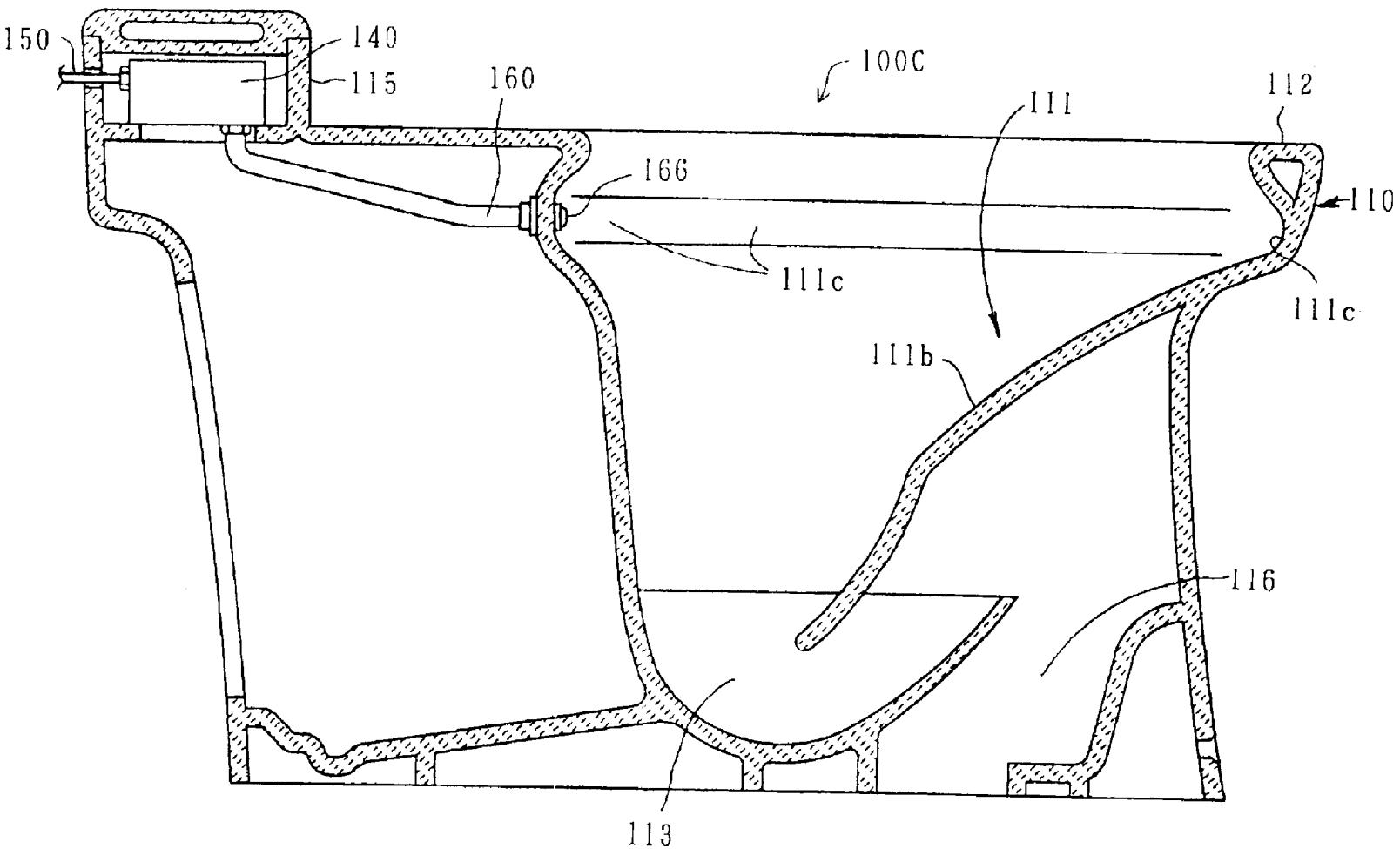
FIG. 17 is a side sectional view of a flush toilet in accordance with a fourth preferred embodiment of the present invention.

As shown in FIG. 17, a flush toilet 100C in accordance with the present preferred embodiment is provided with a passage 116 at its fore portion. Wash water falls down through the passage 116. The flush toilet 100C is not provided with a trap-way, jet water pipe and jet discharge nozzle. The valve unit 140 is not provided with a selector valve device and device for driving the selector valve device. The flush toilet 100C has the same structure as the flush toilet 100 except for aforementioned points.

In the flush toilet 100C, the toilet body is flushed only by the rim flush water discharging from the nozzle 166. The pressurized rim flush water swirls and flows down along the dry surface 111*b* to wash the dry surface 111*b* strongly without causing loud noise. Soil in the concave 113 is discharged from the toilet body 110 through the passage 116.

A fifth preferred embodiment of the present invention will be described.

Figure 18:
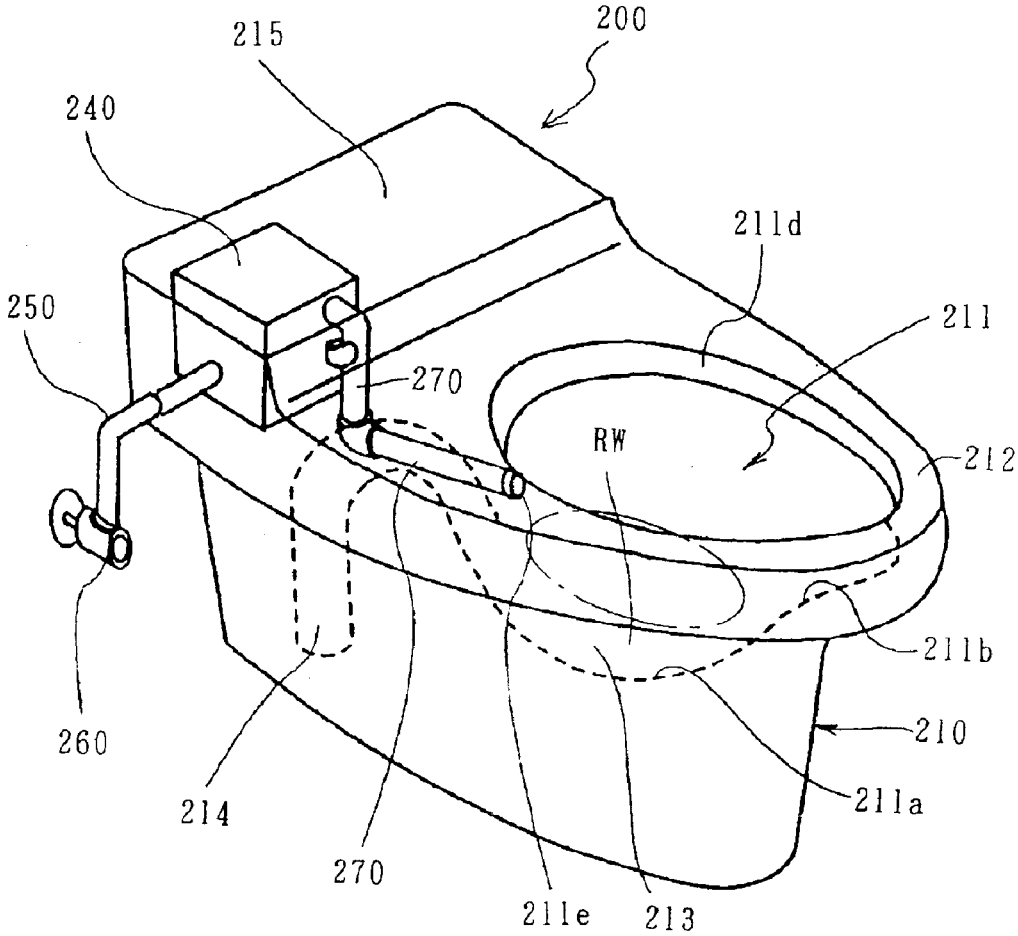
FIG. 18 is a perspective view of a flush toilet in accordance with a fifth preferred embodiment of the present invention.
Figure 19:
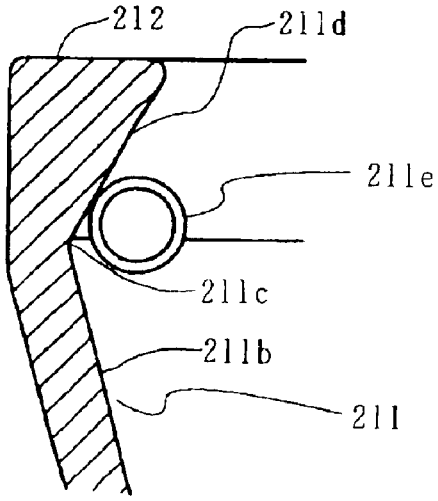
FIG. 19 is a cross-sectional view of the upper end of a bowl of the flush toilet in FIG. 18.

As shown in FIGS. 18 and 19, a flush toilet 200 in accordance with the present preferred embodiment is provided with a toilet body 210 made of ceramic. The toilet body 210 is provided with a bowl 211. The bowl 211 forms a wet surface 211*a* contacting water seal RW at the lower part of its inner surface and a dry surface 211*b* not contacting the water seal RW at the upper part of its inner surface. The dry surface 211*b* is provided with an annulus bent 211*c* at its upper peripheral portion. The annulus bent 211*c* extends substantially horizontally. The bowl 211 forms an annulus rim 212 at its upper end. An overhang 211*d* extends from the annulus bent 211*c* to the annulus rim 212. The annulus bent 211*c* is provided with a wash water discharge hole 211*e* directed in parallel with the longitudinal axis of the annulus bent 211*c*.

A trap-way 214 with reversed S shape extends rearward from the bottom 213 of the bowl 211. The trap-way 214 is connected to a discharge pipe with a socket at its downstream end. The socket is not shown in Figures.

The toilet body 210 is provided with a housing 215 to the rear of the bowl 211.

A valve unit 240 is installed in the housing 215. The valve unit 240 connects to a feed water pipe 250. The feed water pipe 250 connects to a pressurized water source such as a city water supply pipe, a tank set on the roof of a house or a building, a pump, etc. through a stop valve 260.

Figure 20:
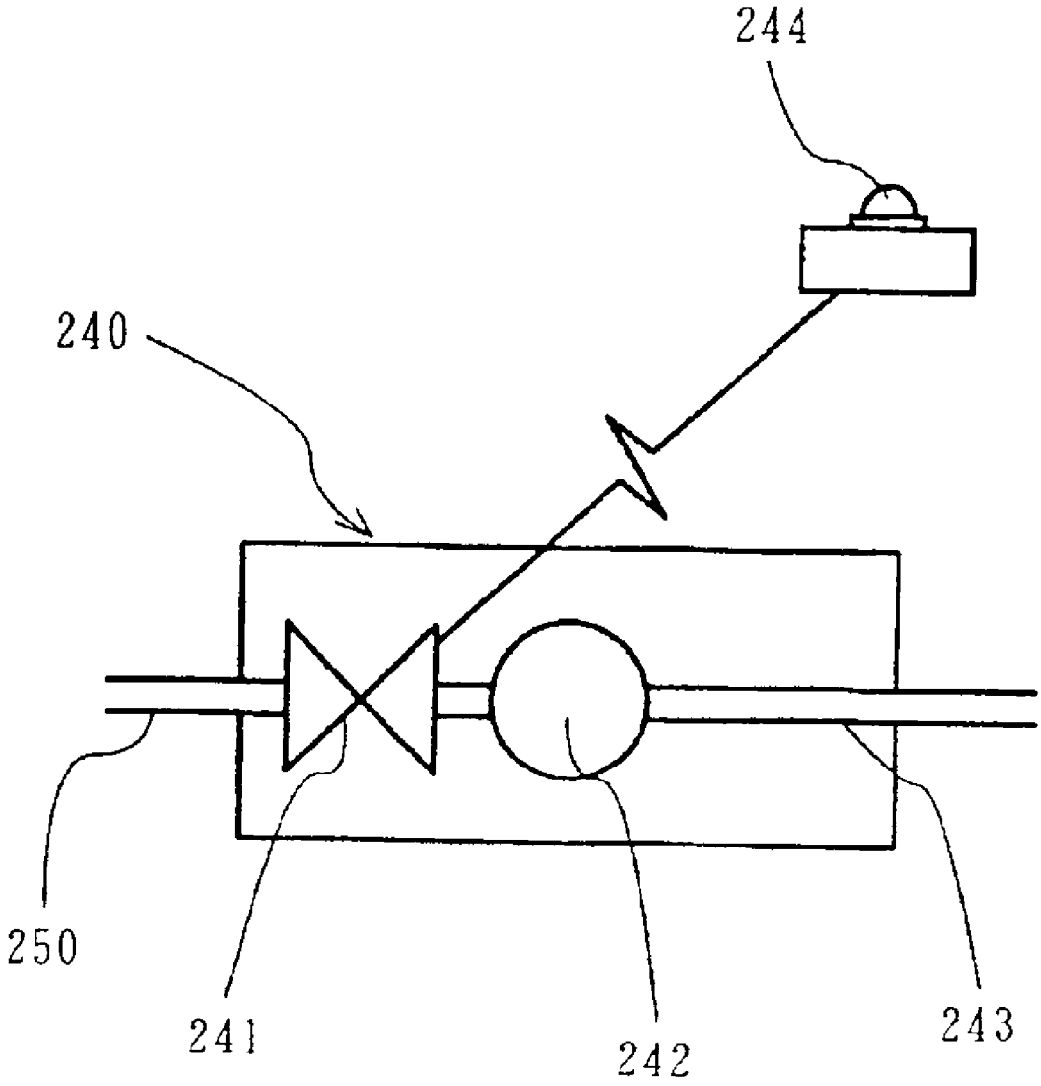
FIG. 20 is a structural view of a valve unit provided for the flush toilet in FIG. 18.

As shown in FIG. 20, the valve unit 240 is provided with an electromagnetic valve 241, a flow regulating valve 242, an internal connection pipe 243 and a manipulation device 244 for controlling the electromagnetic valve 241. They are disposed in series in the said order from upstream to downstream in relation to wash water flow. The electromagnetic valve 242 connects to the feed water pipe 250.

Figure 21:
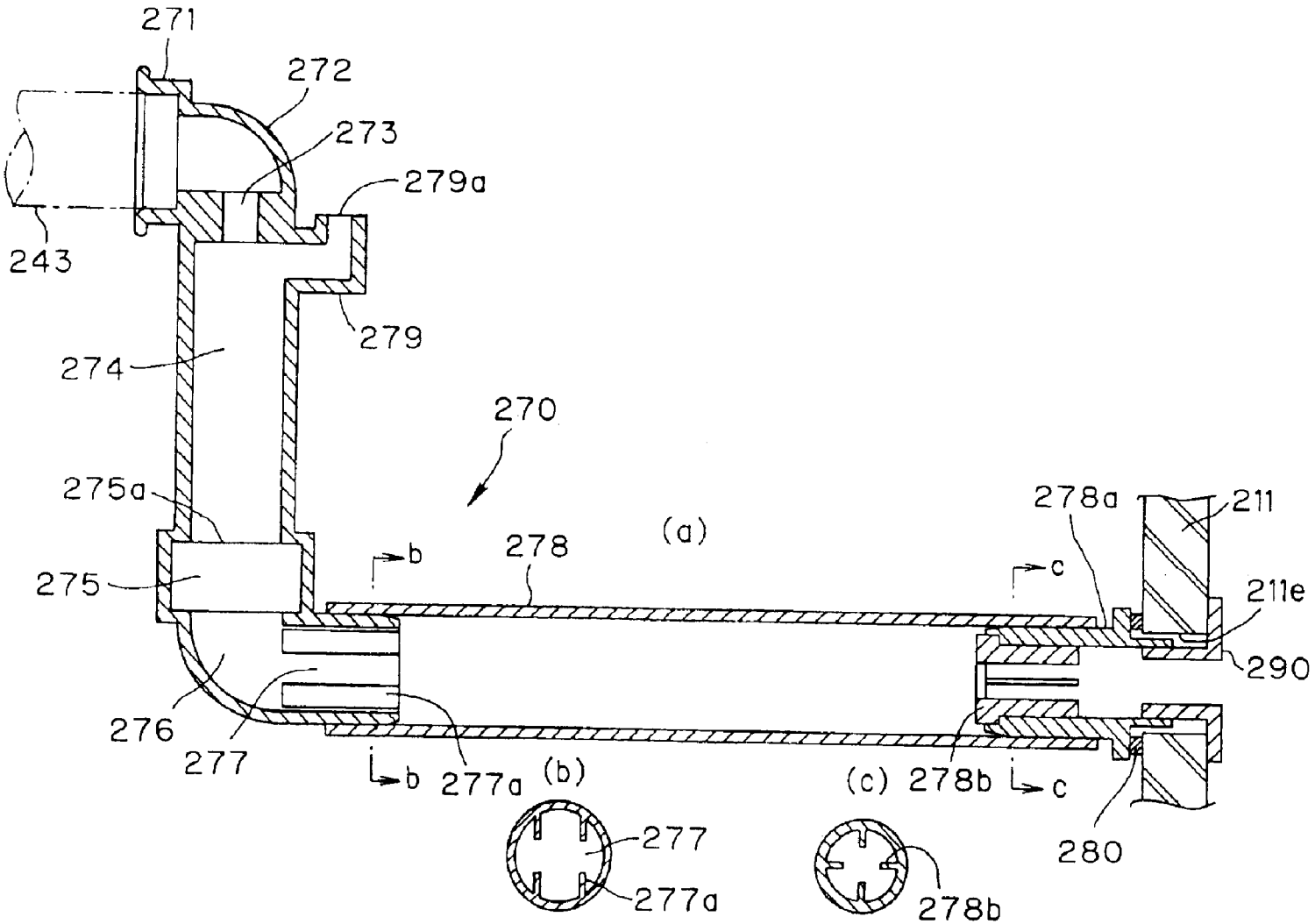
FIG. 21 is a set of sectional views of an air mix device provided for the flush toilet in FIG. 18. (a) is a side sectional view, (b) is a sectional view taken along arrows b—b in (a), and (c) is a sectional view taken along arrows c—c in (a).

An air mix device 270 which also serves as a wash water passage extends from the valve unit 240. As shown in FIG. 21, the air mix device 270 is provided with a connection hole 271, an elbow 272, a straight exhaust nozzle 273 with appropriate length and a diameter smaller than that of the elbow 272, a straight air contact chamber 274 with large length and a diameter larger than that of the exhaust nozzle 273, a straight check chamber 275 for preventing back flow with a diameter larger than that of the air contact chamber 274, an air mix chamber 276 formed by an elbow with a diameter smaller than that of the check chamber 275, a straight rectification chamber 277 with a diameter equal to that of the air mix chamber 276 and a flexible straight connection pipe 278. They are disposed in series in the said order from upstream to downstream in relation to wash water flow. An air intake pipe 279 bent at right angles extends from the upstream end of he air contact chamber 275 beneath the exhaust nozzle 273. The exhaust nozzle 273, the air contact chamber 274 and the check chamber 275 extend substantially vertically, while the rectification chamber 277 and the connection pipe 278 extend substantially horizontally. An open end directed upward of the air intake pipe 279 forms an air intake 279*a*. The check chamber 275 is provided with a step at its upstream end. The step forms a barrier 275*a* for preventing back flow. The rectification chamber 277 is provided with rectification fins 277*a*. A fixing pipe 278*a* fits in the downstream end of the connection pipe 278. The fixing pipe 278*a* is provided with rectification fins 278*b*. The connection hole 271 is connected to an internal connection pipe 243 of the valve unit 240.

Figure 22:
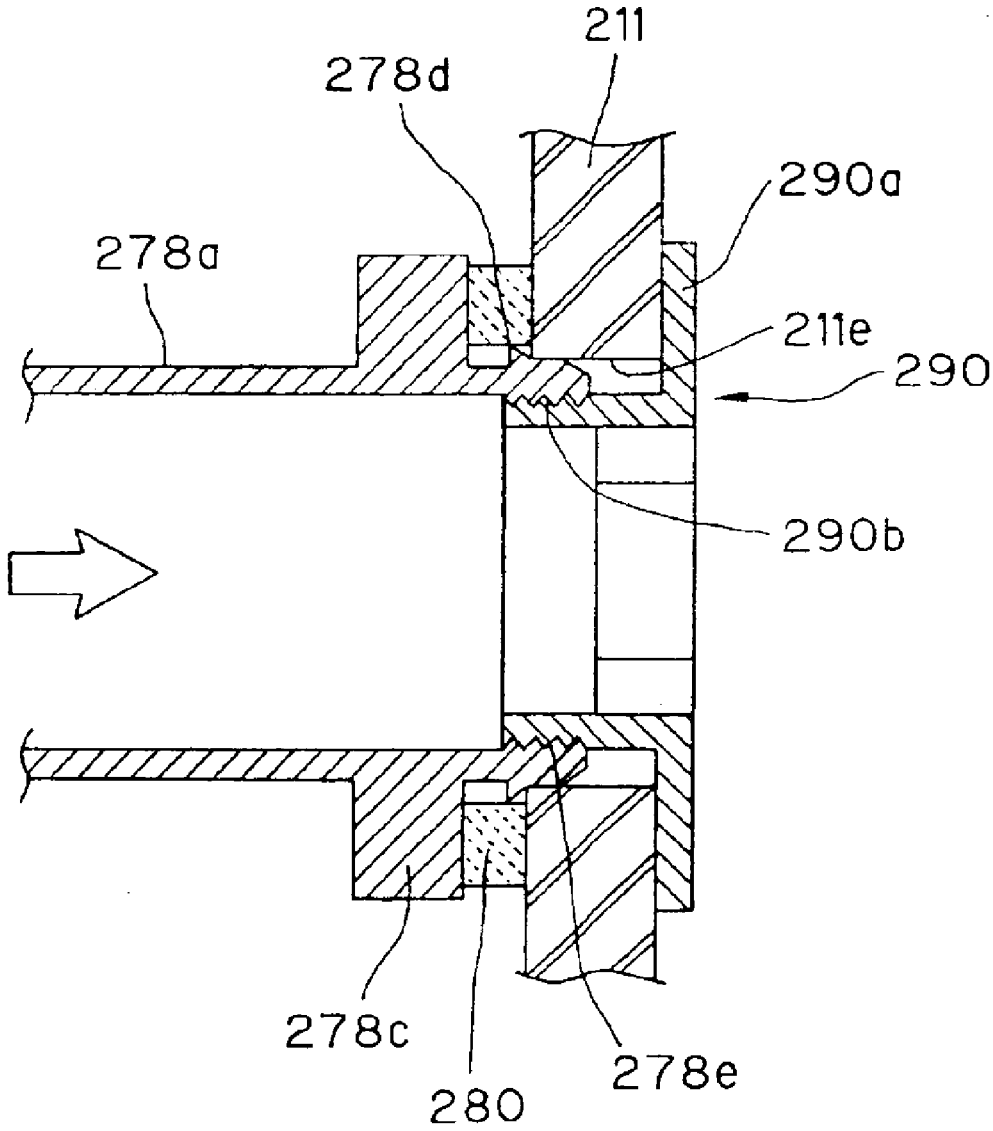
FIG. 22 is a fragmentary enlarged detail of FIG. 21.

As shown in FIG. 22, the fixing pipe 278*a* is provided with a flange 278*c* at its downstream portion. The fixing pipe 278*a* is also provided with a plurality of ribs 278*d* and an internal thread 278*e* at its downstream end. The fixing pipe 278*a* is inserted in the wash water discharge hole 211*e* at its downstream end. A seal member 280 is disposed between the flange 278*c* and the side wall of the bowl 211. A tip pipe 290 is provided with a flange 290*a* and an external thread 290*b*. The external thread 290*b* of the tip pipe 290 is screwed into the internal thread 278*e* of the fixing pipe 278*a*. The flange 278*c* and the flange 290*a* collaborate to clamp the side wall of the bowl 211 and the seal member 280.

The sectional area of the wash water passage downstream of the exhaust nozzle 273 is set larger than that of the exhaust nozzle 273.

Operation of the flush toilet 200 will be described.

When a user manipulates the manipulation device 244 to initiate flushing of the toilet body, the electromagnetic valve 241 in the valve unit 240 opens, and pressurized wash water with constant flow rate flows in the connection hole 271 of the air mix device 270 through the flow regulating valve 242 and the internal connection pipe 243.

Figure 23:
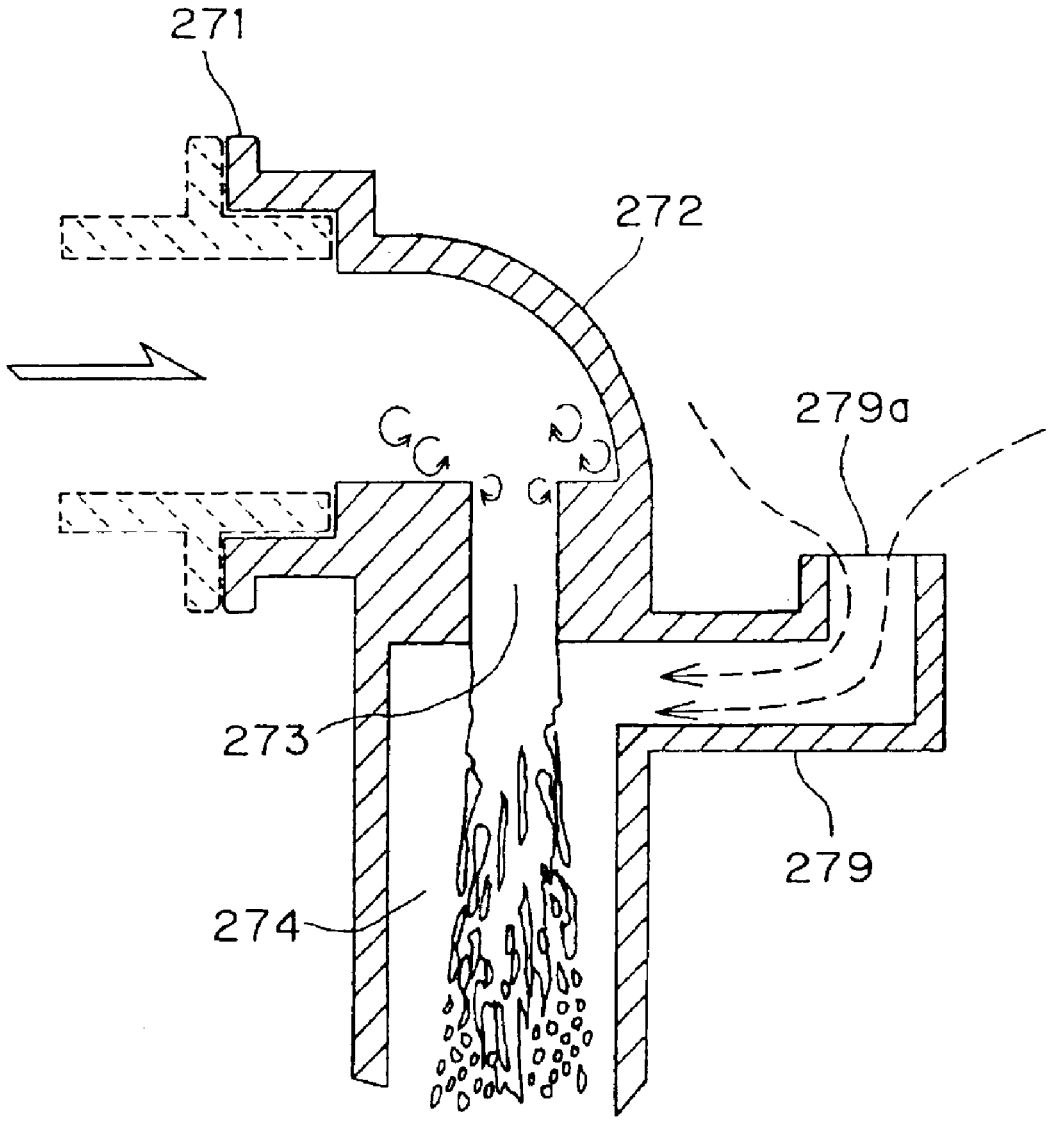
FIG. 23 is a fragmentary side sectional view of the air mix device showing wash water dispersing in an air contact chamber.

As shown in FIG. 23, the wash water passes through the elbow 272 to become turbulent, enters from the elbow 272 into the exhaust nozzle 273 to become further turbulent due to abrupt change of sectional area of wash water passage, and discharges into the air contact chamber 274 filled up with air. The turbulent wash water discharging from the exhaust nozzle 273 into the air forms a turbulent flow structured by a main flow and branched flows having components of flow speed different from that of the main flow. The branched flows project from the surface of the main flow just after discharging to be separated from the main flow due to surface tension and friction force applied by the air around the flows, thereby forming water drops and dispersing radially. When the wash water forms water drops and disperses in the air contact chamber 274, the contact area between wash water and air increases by a large margin, a large quantity of air is mixed in the wash water stably due to friction, the ratio of the mixed air to the wash water increases, and generation of a bubbly stream of wash water described later is promoted. The water drops dispersing radially flows to the downstream to cause an ejector phenomenon, thereby further entraining air in the wash water. The wash water discharges in parallel with the exhaust nozzle 273 or the air contact chamber 274 because the length of the exhaust nozzle 273 is larger than or equal to a predetermined value, and the water drops disperse uniformly in the air contact chamber 274. When the exhaust nozzle 273 is too short, the wash water discharges from the exhaust nozzle 273, while maintaining the component of flow speed which the wash water held before it enters in the elbow 272, the dispersing water drops are biased to the right in FIG. 23, and the quantity of entrained air decreases. The flow regulating valve 242 controls the flow rate of the wash water appropriately to control the flow speed of the wash water in the air contact chamber 274 appropriately, thereby controlling the quantity of the air entrained in the wash water appropriately. Thus, generation of a bubbly stream of wash water is promoted.

The pressure in the air contact chamber 274 becomes negative because the wash water discharging from the exhaust nozzle 273 entrains the air in the air contact chamber 274 to flow to the downstream. Thus, air is sucked naturally from the air intake 279*a* into the air contact chamber 274 through the air intake pipe 279. Freedom in arranging the air intake 279*a* increases owing to the provision of the air intake pipe 279. Therefore, it becomes possible to arrange the air intake 279*a* at a place shielded from the line of sight of a user of the flush toilet and free from splashed water. Provision of the air intake pipe 279 makes it possible to keep noise generated in the air mix chamber 276 apart from the user, thereby enhancing the quietness of the flush toilet 200.

Figure 24:
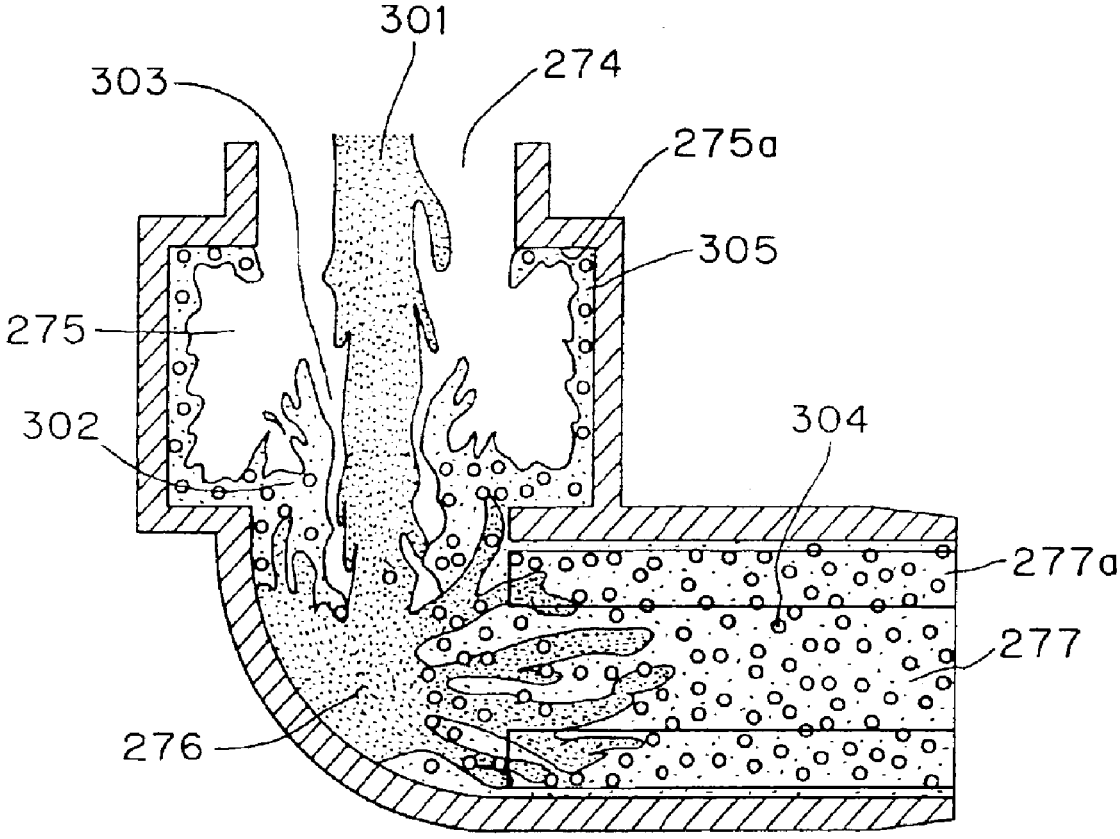
FIG. 24 is a fragmentary side sectional view of the air mix device showing a bubbly stream of wash water generating in an air mix chamber.

As shown in FIG. 24, wash water 301 enters in the air mix chamber 276 at high speed to collide against the bent side wall of the air mix chamber 276, thereby being broken up. A part of the broken up wash water reflects toward the air contact chamber 274 to be stored temporarily in the air mix chamber 276, thereby forming stored water 302. Succeeding wash water 301 rushes into the stored water 302 at high speed. When the succeeding wash water rushes into the stored water, a large quantity of air entrained into the wash water 301 in the air contact chamber 274 forms lumps of air 303. The lumps of air 303 are mixed in the stored water 302. Succeeding wash water 301 rushes into the stored water 302 and the lumps of air 303 to break up the lumps of air 303, thereby forming an abundance of micro air bubbles 304 and dispersing them in the stored water 302. A part of the wash water 301 broken up by the bent side wall of the air mix chamber 276 reflects toward the rectification chamber 277 to entrain the stored water 302 containing an abundance of dispersed micro air bubbles 304, thereby forming a bubbly stream of wash water containing an abundance of dispersed micro air bubbles. The bubbly stream of wash water flows into the rectification chamber 277.

When the wash water 301 rushes into the stored water 302, a part of the stored water 302 forms splashing water 305 directed to the air contact chamber 274. The splashing water 305 flows back along the side wall of the check chamber 275 and is prevented from further flowing back by the barrier 275*a*. Thus, the wash water is prevented from flowing back into the air intake pipe 279. Therefore, air is sucked into the air contact chamber 274 stably.

The bubbly stream of wash water flowing into the rectification chamber 277 swirls because the wash water 301 colliding against the bent side wall of the air mix chamber 276 is applied with a non-uniform force from the side wall. When the bubbly stream of wash water passes through the rectification chamber 277, the rectification fins 277*a* extinguish the swirling motion of the bubbly stream of wash water. Thus, air-wash water separation is prevented.

The bubbly stream of wash water flows into the connection pipe 278 from the rectification chamber 277. When the bubbly stream passes through the connection pipe with appropriate length, distribution of flow speed of the bubbly stream is made uniform. Neither turbulence nor air-wash water separation is generated in the bubbly stream because the connection pipe 278 is straight.

The bubbly stream flows into the fixing pipe 278*a* from the connection pipe 278 to be rectified with the rectification fins 278*b*, thereby being prevented from air-wash water separation. The bubbly stream passes through the tip pipe 290 and discharges into the bowl 211. The apparent volume of the wash water increases due to mixing air into the wash water. Nevertheless, the wash water passes through wash water passages downstream of the exhaust nozzle 273 without difficulty and discharges from the tip pipe 290 because the sectional areas of the wash water passages downstream of the exhaust nozzle 273 are larger than that of the exhaust nozzle 273. The wash water rectified with the rectification fins 278*b* passes through the tip pipe 290 formed highly accurately to discharge with appropriate thickness, thereby enabling stable flushing of the toilet body. The flange 290*a* prevents sewage, chemicals, etc. from entering into the discharge hole 211*e* from the bowl 211 to prevent deterioration of the seal member 280 and enhance the durability and reliability of the seal member 280. The tip pipe 290 can be installed easily from side of the bowl 211. When the flange 290*a* is made thin, it projects little from the dry surface 211*b*, soil adheres little to the flange 290*a* to be removed easily from the flange 290*a*, and the good appearance of the dry surface 211*b* is enhanced.

The bubbly stream of wash water discharges from the tip pipe 290 substantially horizontally along the annulus concave 211*c*. The bubbly stream of wash water does not cause heavy splashing or loud noise when it collides against the dry surface 211*b*. Thus, sanitary and quiet flushing of the dry surface 211*b* is achieved. The bubbly stream of pressurized wash water has large detergency because it flows at high speed. The bubbly stream of wash water swirls along the dry surface 211*b* to wash it. The overhang 211*d* prevents the wash water from splashing out the toilet body 211. The bubbly stream of wash water swirling along the dry surface 211*b* dwells for a long time on the dry surface 211*b* to wash the dry surface 211*b* strongly. The bubbly stream of wash water has strong detergency because it generates high-frequency vibration. Therefore, the bubbly stream of wash water washes the dry surface 211*b* strongly. The wash water used for flushing the dry surface 211*b* is saved by mixing an abundance of air bubbles in the wash water.

The wash water swirls by 360 degrees of more along the dry surface 211*b* to join the water seal RW. The swirling wash water drives the water seal RW to swirl, makes it flow into the trap-way 214 promptly, generates a siphon phenomenon promptly, and discharges soil from the toilet body promptly.

Succeeding wash water flows into the empty bowl 211 to form the water seal RW. Under the control by the manipulating device 244, the electromagnetic valve 241 closes, discharge of the wash water from the tip pipe 290 stops, and the flushing of the toilet body is completed.

The present invention is not limited to the aforementioned embodiments.

In any one of the first to the fourth preferred embodiments, a plurality of nozzles 166 may be disposed apart from each other by a predetermined distance and connected to the rim water pipe 160 through branched pipes. Each of the pressurized wash waters discharging from the plurality of nozzles 166 washes the inner surface of the bowl to enhance the detergency of the flush toilet. The plurality of nozzles 166 may be directed in the same swirling direction or different swirling directions. The aforementioned variation can be applied to the fifth preferred embodiment.

In the first or second preferred embodiment, it is possible to connect a tank directly to the toilet body, and discharge non-pressurized wash water led from the tank as jet flush water BS or the second rim flush water RBS. The jet flush water BS or the second rim flush water RBS does not contribute to flushing the dry surface 111*b*. Therefore, non-pressurized wash water led from a tank directly connected to the toilet body may be used as jet flush water BS or the second rim flush water RBS in a district or in a house where pressurized wash water with ample flow rate cannot be obtained.

In the first or the second preferred embodiment, it is possible to discharge the jet flush water BS or the second rim flush water RBS after the discharging of the rim flush water RS is finished. It can be assumed that the rim flush water RS reaches the water seal RW before the discharge of the rim flush water RS finishes. Therefore, when the jet flush water BS or the second rim flush water RBS discharges after the discharge of the rim flush water RS finishes, the rim flush water RS and the jet flush water BS, or the rim flush water RS and the second rim flush water RBS entrain the water seal RW to promote its flow into the trap-way 114. Thus, the trap-way 114 is filled up with the wash water promptly, a siphon phenomenon appears promptly, the time necessary for flushing the toilet body becomes short, and the quantity of wash water necessary for flushing the toilet body diminishes.

In any one of the first to the fourth preferred embodiments, electromagnetic valves controlled by an electronic circuit or any other valve device controlled by a controller may be used instead of the mechanical valve controller 5 and the pilot operated valve device 21.

Figure 25:
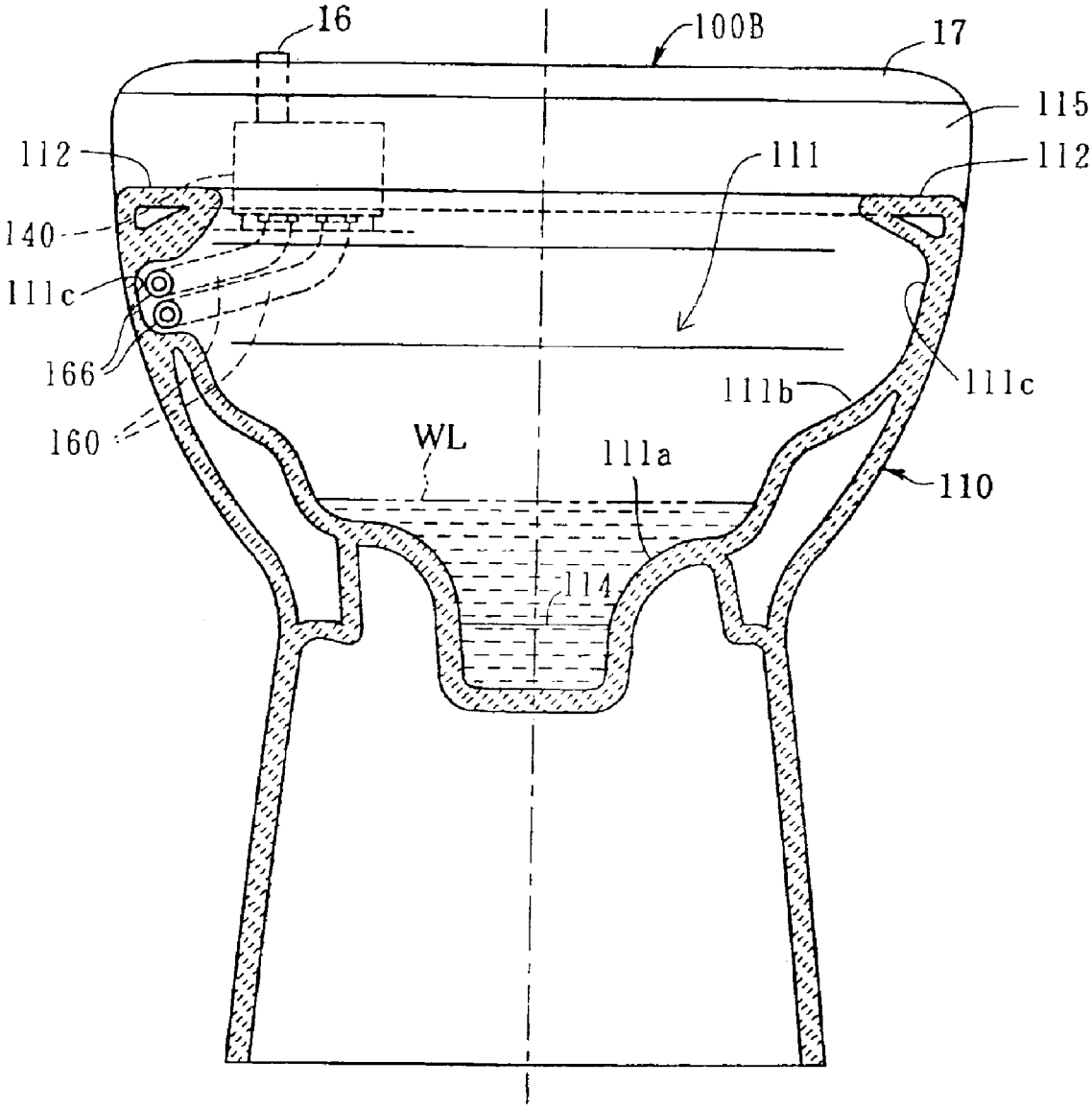
FIG. 25 is a cross-sectional view of a variation of the flush toilet in accordance with the third preferred embodiment of the present invention.

In the third preferred embodiment, it is possible to dispose a pair of rim water pipes 160 and a pair of nozzles 166 in parallel above and below as shown in FIG. 25, and connect the pair of rim water pipes 160 to the valve unit 140. The pair of nozzles 166 discharge pressurized wash water simultaneously to form wide swirling flow of the rim flush water RS, thereby enhancing the detergency of the rim flush water.

In FIG. 25, the lower rim water pipe 160 and the lower nozzle 166 may be moved to the right annulus concave 111*c*. In this case, it is desirable to dispose the right nozzle 166 at a level higher or lower than that of the left nozzle 166 to prevent the rim flush waters RS discharging from the right and left nozzles 166 simultaneously from colliding against each other.

Figure 26:
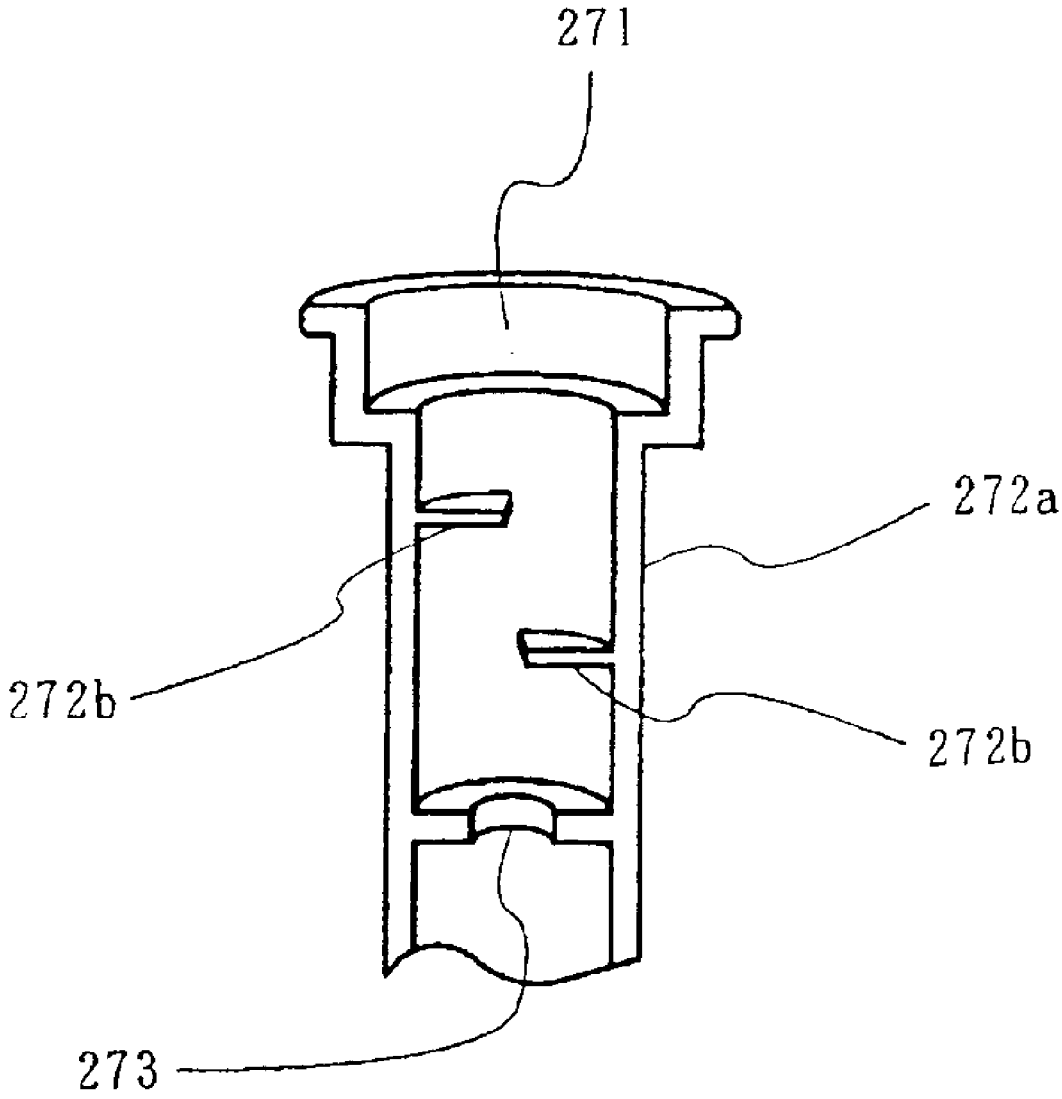
FIG. 26 is a side-sectional view of a variation of a wash water dispersion device in the air mix device provided for the fifth preferred embodiment of the present invention.

In the fifth preferred embodiment, it is possible to connect the connection hole 271 to the exhaust nozzle 273 with a straight pipe 272*a* instead of the elbow 272, and dispose a plurality of half-disk shaped baffle plates 272*b* distanced from each other in the straight pipe 272*a*, in staggered arrangement and at right angles to the flow of the wash water, as shown in FIG. 26. The wash water becomes turbulent when it passes by the baffle plates 272*b* and when it enters into the exhaust nozzle 273 to form water drops and disperses radially in the air contact chamber 274.

Figure 27:
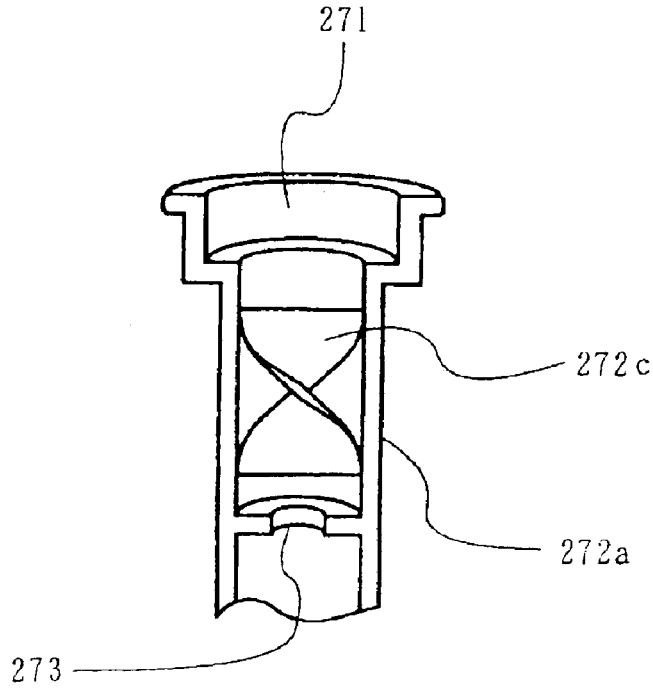
FIG. 27 is a side-sectional view of a variation of a wash water dispersion device in the air mix device provided for the fifth preferred embodiment of the present invention.

In the fifth preferred embodiment, it is possible to connect the connection hole 271 to the exhaust nozzle 273 with a straight pipe 272*a* instead of the elbow 272, and dispose a twisted baffle plate 272*c* in the straight pipe 272*a*, as shown in FIG. 27. The wash water becomes turbulent when it passes by the twisted baffle plate 272*b* and when it enters into the exhaust nozzle 273 to form water drops and disperses radially in the air contact chamber 274. Flow resistance of the baffle plate 272*c* is smaller than that of the baffle plate 272*b*. Thus, energy loss due to generation of turbulence decreases.

Figure 28:
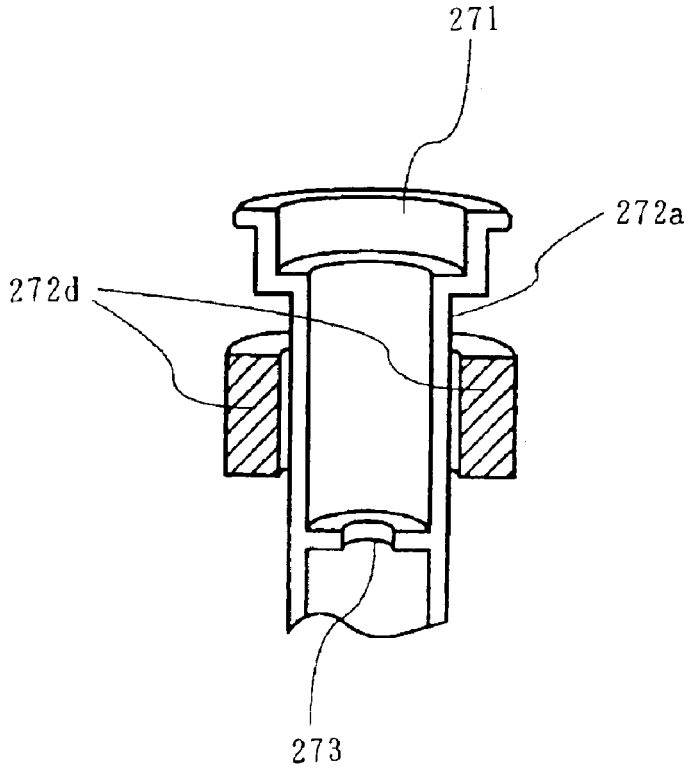
FIG. 28 is a side-sectional view of a variation of a wash water dispersion device in the air mix device provided for the fifth preferred embodiment of the present invention.

In the fifth preferred embodiment, it is possible to connect the connection hole 271 to the exhaust nozzle 273 with a straight pipe 272*a* instead of the elbow 272, and dispose an ultrasonic vibrator 272*d* around the straight pipe 272*a*, as shown in FIG. 28. The wash water passing through the straight pipe 272*a* is vibrated to generate micro air bubbles in it. The bubbles in the wash water are compressed when the wash water passes through the exhaust nozzle 273 with small diameter. The compressed air bubbles grow rapidly just after the wash water discharges from the exhaust nozzle 273 to explode. Thus, the wash water around the air bubbles is broken up to form water drops, thereby dispersing radially in the air contact chamber 274.

Figure 29:
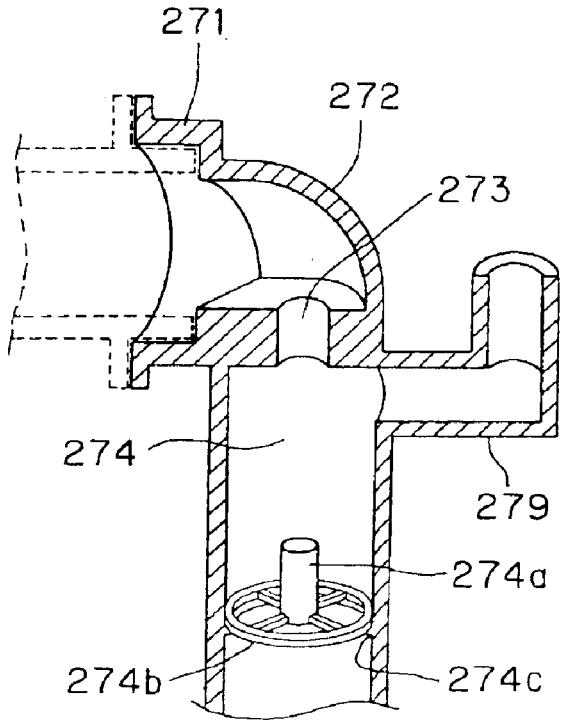
FIG. 29 is a side-sectional view of a variation of a wash water dispersion device in the air mix device provided for the fifth preferred embodiment of the present invention.

In the fifth preferred embodiment, it is possible to engage a grid member 274*b* supporting a column 274*a* with a plurality of projections 274*c* formed on the circumferential wall of the air contact chamber downstream of the air intake pipe 279 and locate the column 274*a* opposite the exhaust nozzle 273, as shown in FIG. 29. The wash water discharging from the exhaust nozzle 273 collides against the column 274*a* to be broken up, thereby forming water drops and dispersing radially. When the column 274*a* is located downstream of the air intake pipe 279, the wash water broken up by the column 274*a* is prevented from entering into the air intake pipe 279. A rod member with any other shape may be used instead of the column 274*a*.

Figure 30:
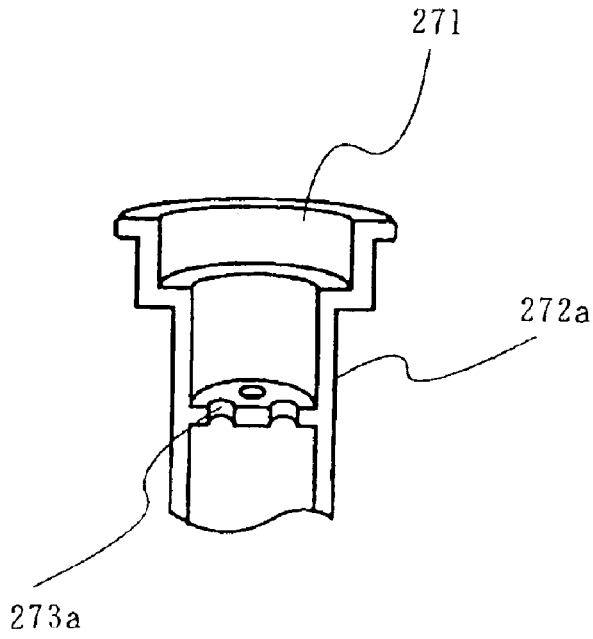
FIG. 30 is a side-sectional view of a variation of a wash water dispersion device in the air mix device provided for the fifth preferred embodiment of the present invention.

In the fifth preferred embodiment, it is possible to dispose a plurality of small discharge holes 273*a* directed radially or aslant relative to the direction to the downstream and connect the connection hole 271 to the exhaust nozzle 273 with a straight pipe 272*a* instead of the elbow 272 as shown in FIG. 30. When the wash water discharges from a plurality of exhaust nozzle 273*a*, the contact surface area between the wash water and the air increases, and the quantity of air entrained by wash water increases. When a plurality of wash water flows discharge radially or aslant, the quantity of air entrained by the wash water increases. The quantity of air entrained by the wash water can be adjusted by adjusting the number the discharge holes 273*a* or the angle of radiation of the discharge holes 273*a*.

Figure 31:
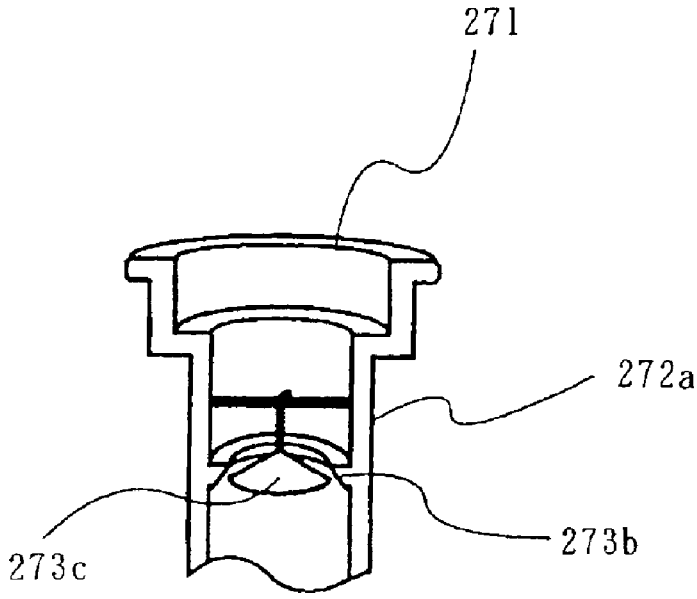
FIG. 31 is a side-sectional view of a variation of a wash water dispersion device in the air mix device provided for the fifth preferred embodiment of the present invention.

In the fifth preferred embodiment, it is possible to dispose a large exhaust nozzle 273*b* conically increasing in diameter toward the downstream, connect the connection hole 271 to the exhaust nozzle 273 with a straight pipe 272*a* instead of the elbow 272, dispose a baffle plate 273*c* conically increasing in diameter toward the downstream in the exhaust nozzle 273*b*, and support the baffle plate 273*c* with an appropriate support member, as shown in FIG. 31. The wash water passes through an annulus space between the exhaust nozzle 273*b* and the baffle plate 273*c* increasing in diameter toward the downstream, discharges from the annulus space, and forms a water screen to spread in the air contact chamber 274. Thus, the contact surface area between the wash water and air increases and the quantity of air entrained by wash water increases.

The aforementioned devices for dispersing wash water may be combined. In this case, the contact surface area between the wash water and air in the air contact chamber 274 increases and the quantity of air entrained by wash water increases.

Figure 32:
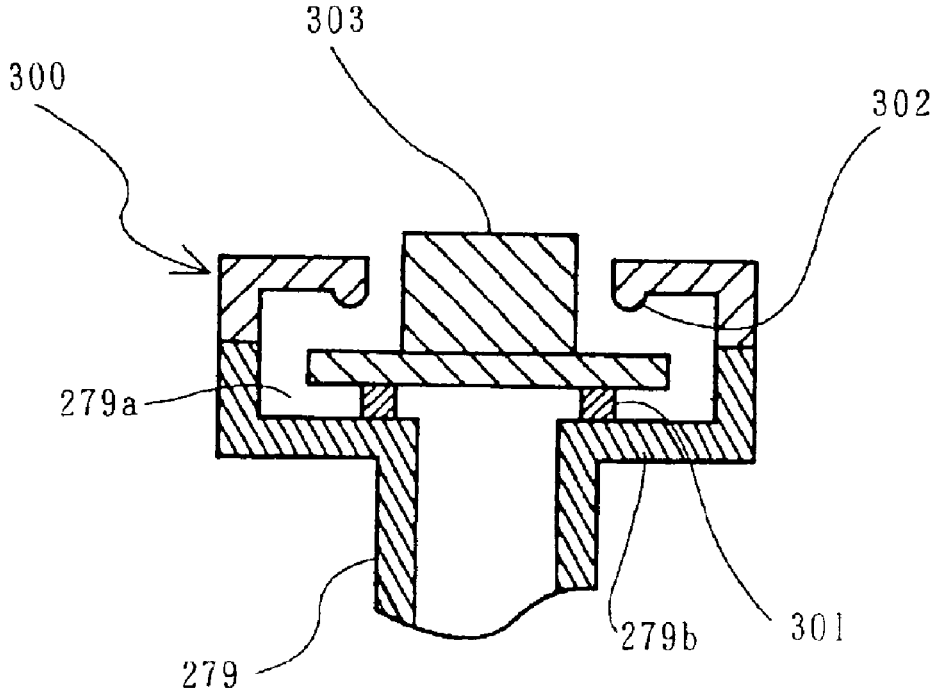
FIG. 32 is a side-sectional view of a back flow prevention device which can be used in the air mix device provided for the fifth preferred embodiment of the present invention.

In the fifth preferred embodiment, it is possible to dispose a check valve 300 in the air intake 279*a* as shown in FIG. 32. The check valve 300 is provided with a plurality of support projections 301 fixed on a flange like expansion 279*b* formed at the upstream end of the air intake pipe 279, a flange like valve seat 302 fixed on the upstream end of the air intake pipe 279, and a movable valve body 303 disposed between the flange like expansion 301 and the flange like valve seat 302. The movable valve body 303 is made of a material with density smaller than that of wash water.

When the air intake pipe 279 operates normally, the movable valve body 303 leaves the valve seat 302 under its own weight to engage the support projections 301. When the pressure in the air contact chamber 274 become negative, air is sucked into the air intake pipe 279 through spaces between adjacent support projections 301 to be sucked into the air contact chamber 274 through the air intake pipe 279. When the air contact chamber 274 is filled up with wash water and the wash water flows back into the air intake pipe 279 due to some cause, the movable valve body 303 is applied with buoyancy from the wash water to leave the support projections 301 and abut against the valve seat 302. Thus, the check valve 300 closes to prevent the wash water from flowing out the air intake pipe 279.

Figure 33:
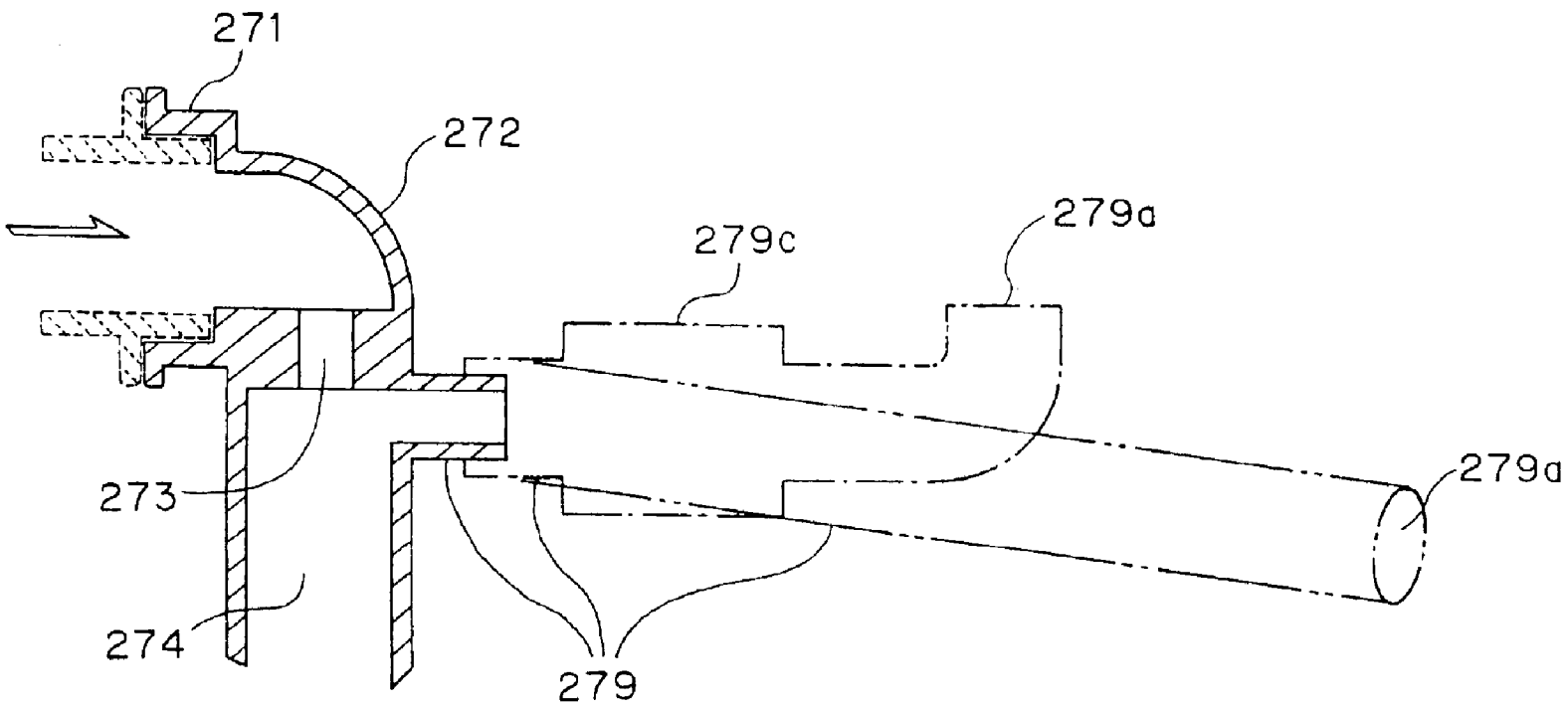
FIG. 33 is a fragmentary side-sectional view of a variation of the air mix device provided for the fifth preferred embodiment of the present invention.

In the fifth preferred embodiment, it is possible to form a swelling 279*c* in the middle of the air intake pipe 279 as indicated by chain lines in FIG. 33. The swelling 279*c* operates as a silencer to prevent noise generated when air is mixed in wash water in the air mix chamber 276 from leaking outside.

In the fifth preferred embodiment, it is possible to elongate the air intake pipe 279 to connect the air intake 279*a* to a hole formed in the inner surface of the bowl 211 above the water seal RW, desirably above the discharge hole 211*e* as indicated by two-dot chain lines in FIG. 33. When the air contact chamber 274 is filled up with wash water and the wash water flows back into the air intake pipe 279 due to some cause, the wash water is discharged in the bowl 211. Therefore, the flush toilet is free from leakage of wash water and sanitary. The air passing trough the air intake pipe 279 at high speed is prevented from contacting the wash water. Thus, quietness of the flush toilet 200 is enhanced. When the elongated part of the air intake pipe 279 extends aslant downward to the bowl 211 as indicated by two-dot chain lines in FIG. 33, discharging of the wash water flowing back to the air intake pipe 279 to the bowl 211 is promoted.

Figure 34:
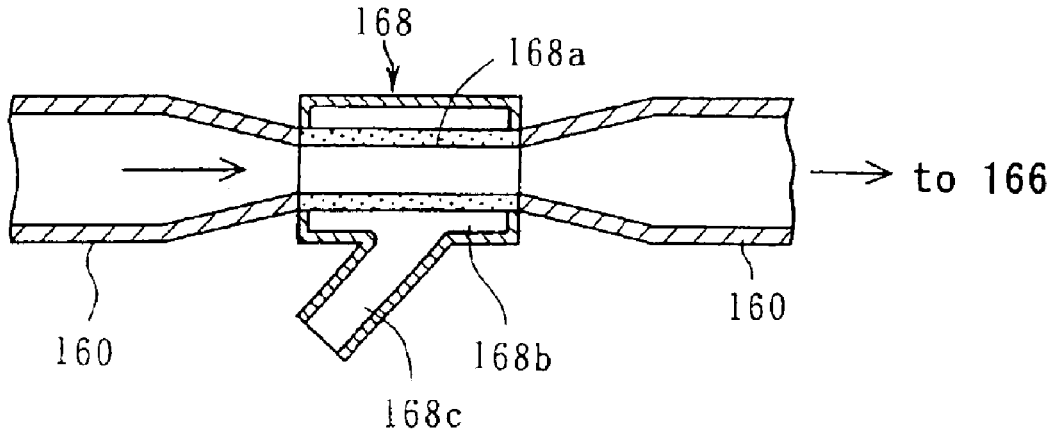
FIG. 34 is a side-sectional view of an air mix device which can be used in any one of the flush toilets in accordance with the first preferred embodiment to the fourth preferred embodiment of the present invention.

In any one of the first to the fourth preferred embodiments, the rim water pipe 160 may be reduced in diameter partially, and provided with an air mix device 168 having a cylindrical suction head 168*a* made of porous material such as ceramic, etc., an air chamber 168*b* surrounding the suction head 168*a* and an air intake pipe 168*c* extending from the air chamber 168*b* at its portion with reduced diameter, as shown in FIG. 34. The wash water flows in the suction head 168*a* at high speed to generate negative pressure in the suction head 168*a*. Thus, air is sucked into the air chamber 168*b* through the air intake pipe 168*c*, passes through micro pores in the suction head 168*a* to form micro air bubbles, and disperses into the wash water flowing in the suction head 168*a*. A bubbly stream of wash water containing an abundance of micro air bubbles dispersed in it discharges from the nozzle 166 to form rim flush water RS composed of a bubbly stream. When the rim flush water RS is composed of a bubbly stream, wash water necessary for flushing the toilet body decreases, while the detergency of the rim flush water RS increases. It is possible to control the flow rate of the wash water with a flow regulating valve, thereby controlling the flow speed of the wash water flowing in the suction head 168*a*, optimizing the quantity of the air mixed into the wash water and promoting the generation of the bubbly stream.

When the length of the air intake pipe 168*c* is optimized, freedom in arranging the air intake increases. Therefore, it becomes possible to arrange the air intake at a place shielded from the line of sight of a user of the flush toilet and free from splashed water. It becomes possible to keep noise generated in the air mix device apart from the user, thereby enhancing quietness of the flush toilet.

It is possible to elongate the air intake pipe 168*c* to connect it to a hole formed in the dry surface 111*b*, desirably above the nozzle 166. When the wash water flows back into the air intake pipe 168*c* due to some cause, the wash water is discharged in the bowl 111. Therefore, the flush toilet is free from leakage of wash water and sanitary. The air passing trough the air intake pipe 168*c* at high speed is prevented from contacting the wash water. Thus, the quietness of the flush toilet is enhanced. When the elongated part of the air intake pipe 168*c* extends aslant downward to the bowl 111, discharging of the wash water flowing back to the air intake pipe 168*c* to the bowl 111 is promoted.

Figure 35:
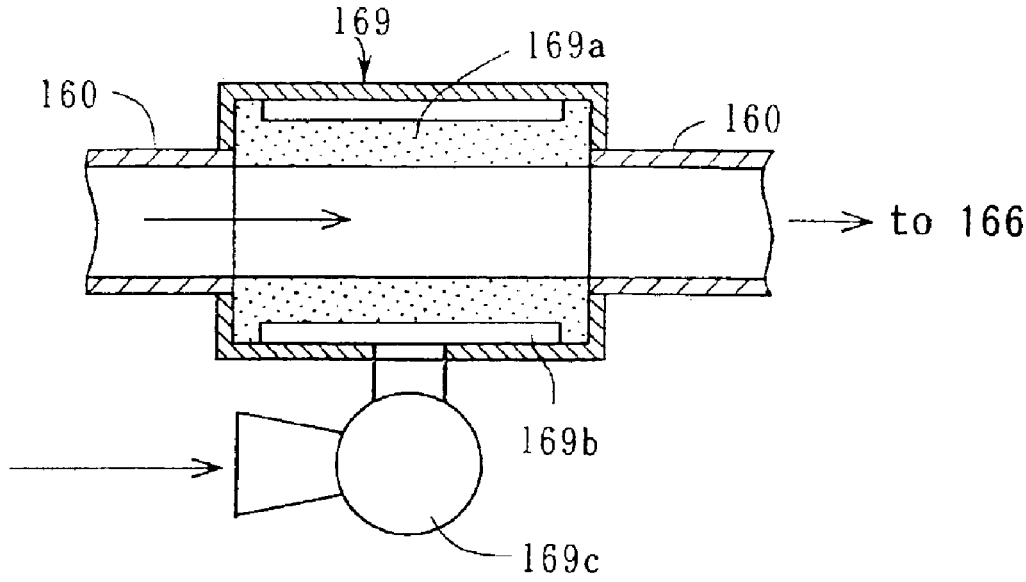
FIG. 35 is a side-sectional view of an air mix device which can be used in any one of the flush toilets in accordance with the first preferred embodiment to the fourth preferred embodiment of the present invention.

In any one of the first to the fourth preferred embodiments, the rim water pipe 160 may be provided with an air mix device 169 having a cylindrical suction head 169*a* made of porous material such as ceramic, etc., an air chamber 169*b* surrounding the suction head 169*a* and a compressor 169*c* communicating with the air chamber 168*b*, as shown in FIG. 35. When the compressor 169*c* operates, micro air bubbles are forced to disperse into the wash water flowing in the suction head 169*a*. Thus, the ratio of mixed air to the wash water becomes larger than that in the natural suction shown in FIG. 34, and the quantity of wash water necessary for flushing the toilet body further decreases.

Figure 36:
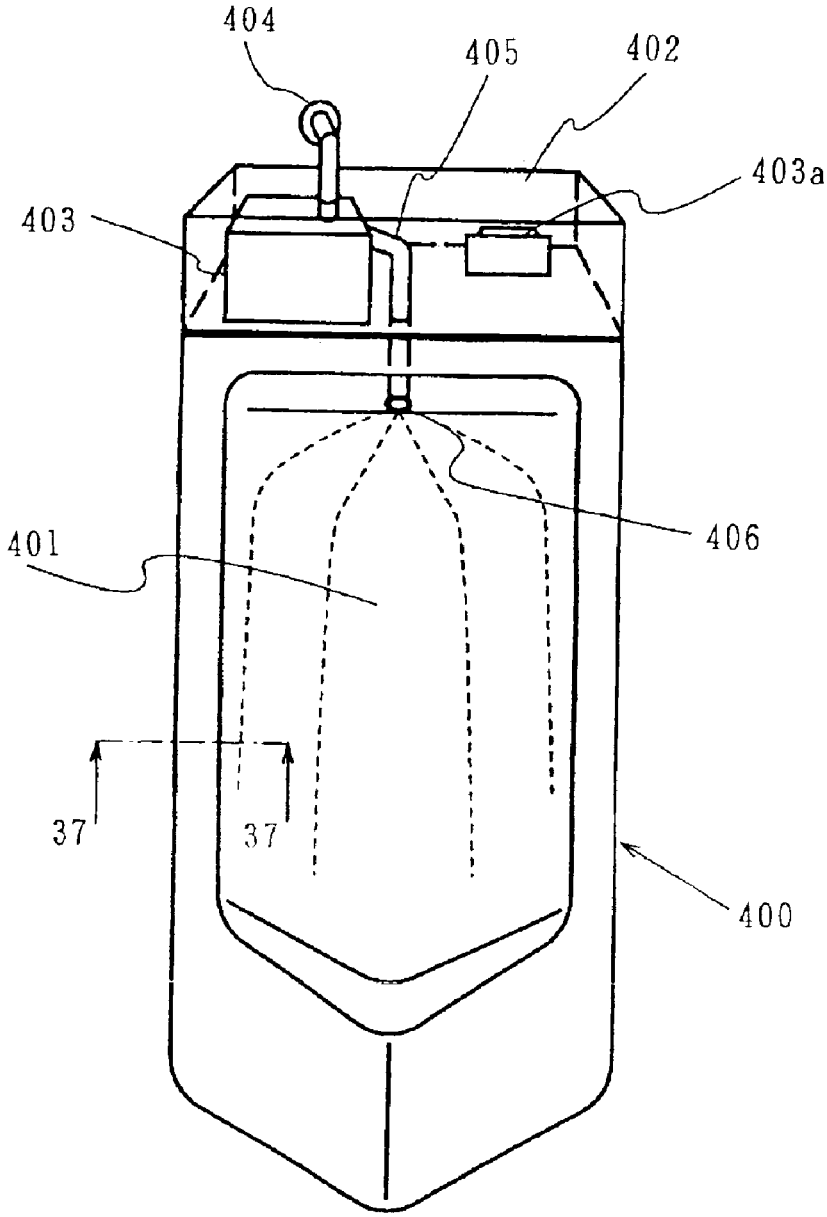
FIG. 36 is a perspective view of a urinal to which the present invention is applied.

As shown in FIG. 36, a bubbly stream of wash water can be used for a flushing type urinal 400.

Figure 37:
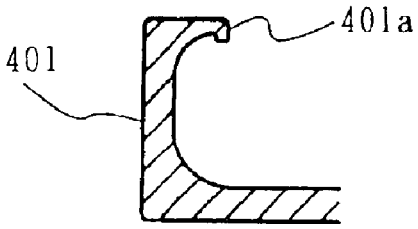
FIG. 37 is a sectional view taken along arrows 37—37 in FIG. 36.

The flushing type urinal 400 is provided with a bowl 401, a housing 402 located above the bowl 401 and a valve unit 403 disposed in the housing 402. The valve unit 403 is connected to a feed water pipe 404 extending from a pressurized water source not shown in Figures. The valve unit 403 is provided with a sensor 403*a* for detecting the human body and a valve linked to the sensor 403. The valve is not shown in Figures. An air mix device 405 which also serves as a wash water passage extends from the valve unit 403 to connect to a discharge hole 406 formed in the upper end of the side wall of the bowl 401. As shown in FIG. 37, overhangs 401*a* are formed at opposite sides of the bowl 401.

In the flushing type urinal 400, the valve in the valve unit 403 opens depending on the start signal from the sensor 403*a*, wash water flows to the air mix device 405 from the feed water pipe 404 to form bubbly stream, and discharges from the discharge hole 406. The discharging bubbly stream of wash water spreads radially as indicated by dot lines to flow down along the inner surface of the bowl 401. The overhangs 401*a* prevent the wash water from splashing out the bowl 401. The bubbly stream of wash water having strong detergency washes the inner surface of the bowl 401 strongly.

INDUSTRIAL APPLICABILITY OF THE INVENTION

The flush toilet of the present invention can be used not only for closets but also for urinals.

What is claimed is:

1. A flush toilet comprising:

a toilet body having a bowl for storing wash water as a water seal and a rim, wherein the bowl includes an inner surface having a lower wet part contacting the water seal and an upper dry part, wherein the upper dry part of the inner surface is provided with an annulus concave extending substantially horizontally at an upper peripheral portion of the inner surface and with an overhang disposed between the annulus concave and the rim;

first means for supplying the toilet body with pressurized wash water; and second means for discharging the wash water substantially horizontally along the upper peripheral portion of the inner surface of the bowl to swirl the wash water along the inner surface of the bowl, wherein the second means includes a nozzle directed in parallel with a longitudinal axis of the annulus concave so as to swirl wash water into and in parallel with the annulus concave.

2. A flush toilet of claim 1, comprising a plurality of the second means.

3. A flush toilet of claim 1, further comprising a trap-way extending from the bottom of the bowl and third means for discharging wash water to direct it to an inlet of the trap-way.

4. A flush toilet of claim 3, wherein the third means discharges pressurized wash water.

5. A flush toilet of claim 3, further comprising fourth means for supplying non-pressurized wash water, wherein the third means discharges non-pressurized wash water.

6. A flush toilet of claim 3, wherein the third means discharges the wash water below the water plane of the water seal.

7. A flush toilet of claim 3, further comprising fifth means for controlling the discharging of wash water from the second means and the discharging of wash water from the third means.

8. A flush toilet of claim 7, wherein the fifth means controls the third means to discharge wash water after the pressurized wash water discharging from the second means reaches the water seal.

9. A flush toilet of claim 7, wherein the fifth means controls the third means to discharge wash water after the second means finishes discharging the pressurized wash water.

10. A flush toilet of claim 1, wherein the toilet body is made of ceramic and the second means comprises a nozzle mounted on the upper peripheral portion of the bowl.

11. A flush toilet of claim 10, further comprising a pipe for leading the pressurized wash water to the nozzle.

12. A flush toilet of claim 1, wherein a quantity of wash water discharging from the toilet body when the toilet body is flushed is not more than 7 liters.

13. A flush toilet of claim 1, further comprising sixth means for mixing the pressurized wash water discharging from the second means with air.

14. A flush toilet of claim 13, further comprising seventh means for controlling the flow rate of the pressurized wash water discharging from the second means.

15. A flush toilet of claim 13, further comprising an air intake pipe communicating with the sixth means at its one end and exposed to the atmosphere at it's the other end.

16. A flush toilet of claim 15, wherein the air intake pipe comprises eight means for discharging wash water flowing back from the sixth means.

17. A flush toilet of claim 15, wherein the other end of the air intake pipe exposed to the atmosphere opens in the inner surface of the bowl of the toilet body above the water seal.

18. A flush toilet of claim 13, wherein the sixth means comprises an exhaust nozzle for wash water, an air intake exposed to the atmosphere, an air contact chamber disposed downstream of and close to the exhaust nozzle, communicating with the air intake, storing sucked air temporarily, and making wash water discharging from the exhaust nozzle contact the stored air, and an air mix chamber disposed downstream of the air contact chamber and mixing the wash water with the air.

19. A flush toilet of claim 18, further comprising ninth means for dispersing wash water exhausting from the exhaust nozzle in the air contact chamber.

20. A flush toilet of claim 19, wherein the ninth means generates turbulence in the wash water at the exhaust nozzle or at a position upstream of and close to the exhaust nozzle.

21. A flush toilet of claim 18, wherein sectional areas of the air contact chamber and the wash water passage downstream of the air contact chamber are larger than that of the exhaust nozzle.

22. A flush toilet of claim 18, wherein the air intake is connected to the air contact chamber through an air intake pipe.

23. A flush toilet of claim 22, wherein the air intake pipe comprises tenth means for discharging the wash water flowing back from the air contact chamber.

24. A flush toilet of claim 18, wherein the air intake opens in the inner surface of the bowl of the toilet body above the water seal.

25. A flush toilet of claim 18, wherein the air mix chamber is bent.

26. A flush toilet of claim 18, further comprising eleventh means for rectifying the bubbly stream of wash water downstream of the air mix chamber.

27. A flush toilet comprising:

a toilet body having a bowl for storing wash water as a water seal;

first means for supplying the toilet body with pressurized wash water;

second means for discharging the wash water substantially horizontally along the upper peripheral portion of the inner surface of the bowl to swirl the wash water along the inner surface of the bowl;

a trap-way extending from the bottom of the bowl; and third means for discharging wash water to direct wash water to an inlet of the trap-way, wherein the third means makes the discharging wash water swirl in the same direction as the pressurized wash water discharging from the second means.

* * * * *